US008948428B2

(12) United States Patent
Kates

(10) Patent No.: US 8,948,428 B2
(45) Date of Patent: Feb. 3, 2015

(54) HEARING AID WITH HISTOGRAM BASED SOUND ENVIRONMENT CLASSIFICATION

(75) Inventor: James Mitchell Kates, Niwot, CO (US)
(73) Assignee: GN Resound A/S, Ballerup (DK)

( * ) Notice: Subject to any disclaimer, the term of this patent is extended or adjusted under 35 U.S.C. 154(b) by 1117 days.

(21) Appl. No.: 12/440,213
(22) PCT Filed: Sep. 4, 2007

(86) PCT No.: PCT/DK2007/000393
§ 371 (c)(1),
(2), (4) Date: May 12, 2009

(87) PCT Pub. No.: WO2008/028484
PCT Pub. Date: Mar. 13, 2008

(65) Prior Publication Data

US 2010/0027820 A1 Feb. 4, 2010

Related U.S. Application Data

(60) Provisional application No. 60/842,590, filed on Sep. 5, 2006.

(30) Foreign Application Priority Data

Sep. 5, 2006 (DK) ..... 2006 01140

(51) Int. Cl.
*H04R 25/00* (2006.01)
*G10L 25/00* (2013.01)
*G10L 25/78* (2013.01)

(52) U.S. Cl.
CPC ..... *G10L 25/00* (2013.01); *H04R 25/505* (2013.01); *G10L 2025/783* (2013.01); *H04R 25/507* (2013.01); *H04R 2225/41* (2013.01); *H04R 2430/03* (2013.01)
USPC ..... 381/315; 381/312

(58) Field of Classification Search
CPC ..... H04R 25/00; H04R 25/55; H04R 25/552; H04R 29/00; H04R 25/30; H04R 25/50; G02C 11/06
USPC ..... 381/94.1, 94.2, 94.3, 94.4, 94.5, 94.6, 381/94.7, 94.8, 94.9, 23.1, 312, 313, 314, 381/315
See application file for complete search history.

(56) References Cited

U.S. PATENT DOCUMENTS 4,852,175 A 7/1989 Kates
5,687,241 A 11/1997 Ludvigsen
(Continued)

FOREIGN PATENT DOCUMENTS

EP 0 732 036 B1 5/1997
WO 01 76321 A1 10/2001
(Continued)

OTHER PUBLICATIONS

Stoeckle S. et al., "Environmental Sound Sources Classification Using Neural Networks", IEEE, Nov. 18, 2001, p. 399-404, New Jersey, USA.
(Continued)

*Primary Examiner* — Brian Ensey
(74) *Attorney, Agent, or Firm* — Vista IP Law Group, LLP

(57) ABSTRACT

A hearing aid includes a microphone and an A/D converter for provision of a digital input signal in response to a sound signal received at the microphone in a sound environment, a processor that is configured to process the digital input signal in accordance with a signal processing algorithm to generate a processed output signal, a sound environment detector for determination of the sound environment based at least in part on the digital input signal, and for providing an output for selection of the signal processing algorithm, the sound environment detector including (1) a feature extractor for determination of histogram values of the digital input signal in a plurality of frequency bands, (2) an environment classifier configured for classifying the sound environment into a number of environmental classes based at least in part on the determined histogram values from at least two of the plurality of frequency bands, and (3) a parameter map for the provision of the output for the selection of the signal processing algorithm, and a D/A converter and an output transducer for conversion of the processed output signal to an acoustic output signal.

29 Claims, 19 Drawing Sheets

(56) References Cited

U.S. PATENT DOCUMENTS

Figure 1:
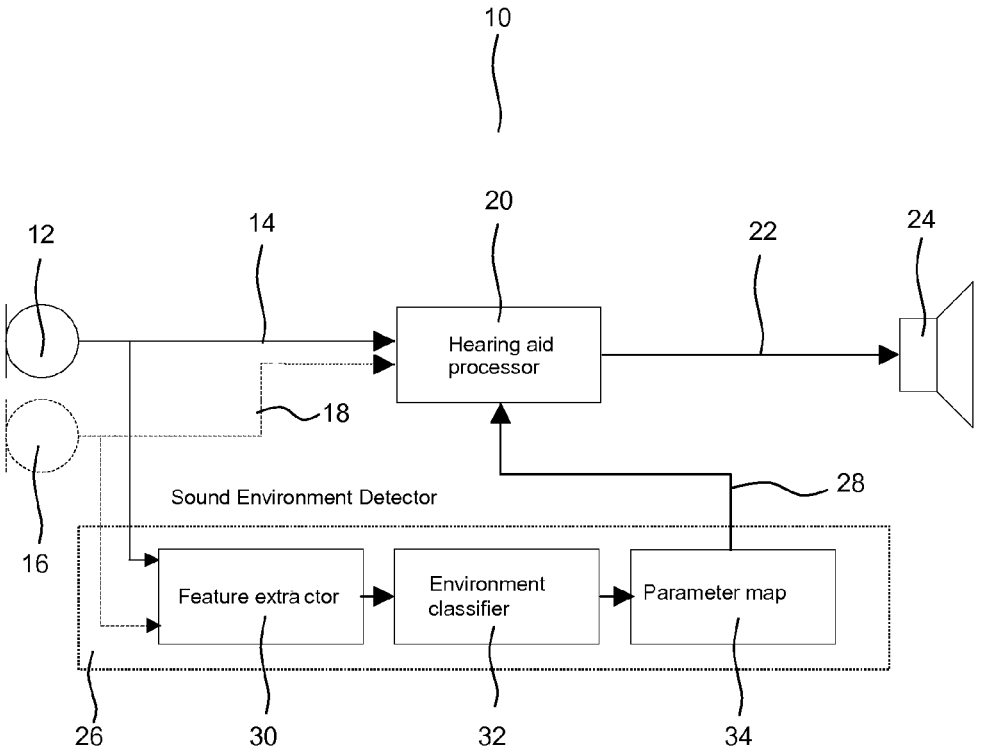

| | | | | |
|---|---|---|---|---|
| 6,570,991 | B1 * | 5/2003 | Scheirer et al. | 381/110 |
| 2002/0037087 | A1 * | 3/2002 | Allegro et al. | 381/317 |
| 2003/0144838 | A1 | 7/2003 | Allegro | |
| 2004/0172240 | A1 * | 9/2004 | Crockett et al. | 704/205 |
| 2004/0175008 | A1 | 9/2004 | Roeck et al. | |
| 2004/0231498 | A1 | 11/2004 | Li et al. | |

FOREIGN PATENT DOCUMENTS

| | | | |
|---|---|---|---|
| WO | WO 01/76321 | A1 | 10/2001 |
| WO | 2004 114722 | A1 | 12/2004 |
| WO | 2008 028484 | A1 | 3/2008 |

OTHER PUBLICATIONS

International Search Report for Application No. PCT/DK2007/000393.
Written Opinion of the International Searching Authority for Application No. PCT/DK2007/000393.
Danish Search Report for Application No. PA 2006 01140, dated Mar. 16, 2007.
Chinese Office Action for Chinese Application No. 200780038455.0 dated Dec. 8, 2011.
Brian C. J. Moore et al., "Suggested formulae for calculating auditory-filter bandwidths and excitation patterns", J Acoust. Soc. Am., vol. 74, No. 3, Sep. 1983, pp. 750-753.
Peter Nordqvist et al., "An efficient robust sound classification algorithm for hearing aids", J. Acoust. Soc. Am., vol. 115, No. 6, Jun. 2004, pp. 3033-3041.
Julius O. Smith III et al., "Bark and ERB Bilinear Transforms", IEEE Transactions on Speech and Audio Processing, Dec. 1999, 32 pages.
E. Zwicker et al., "Analytical expressions for critical-band rate and critical bandwidth as a function of frequency", J. Acoust. Soc. Am., vol. 68, No. 5, Nov. 1980, pp. 1523-1525.
Lawrence R. Rabiner, "A Tutorial on Hidden Markov Models and Selected Applications in Speech Recognition", Proceedings of the IEEE, vol. 77, No. 2, Feb. 1989, pp. 257-286.
David J.C. Mackay, "Information Theory, Inference, and Learning Algorithms", Cambridge University Press, Version 6.0, Jun. 26, 2003, 640 pages.
Howard Demuth et al., "Neural Network Toolbox", The MathWorks, User's Guide, Version 5, 848 pages.
James M. Kates, "Applications of Digital Signal Processing to Audio and Acoustics", 75 pages.
James M. Kates, "Dynamic-Range Compression Using Digital Frequency Warping", 5 pages.
James M. Kates, "Classification of background noises for hearing-aid applications", J. Acoust. Soc. Am., vol. 97, No. 1, Jan. 1995, 10 pages.
James M. Kates et al., "Multichannel Dynamic-Range Compression Using Digital Frequency Warping", EURASIP Journal on Applied Signal Processing 2005:18, 26 pages.
Rainer Huber, "Objective assessment of audio quality using an auditory processing model", 142 pages.
Aki Harma et al., "Frequency-Warped Signal Processing for Audio Applications", J. Audio Eng., vol. 48, No. 11, Nov. 2000, pp. 1011-1031.
Torsten Dau et al., "Modeling auditory processing of amplitude modulation. I. Detection and masking with narrow-band carriers", J. Acoust. Soc. Am., vol. 102, No. 5, Pt. 1, Nov. 1997, pp. 2892-2905.
Ralph P. Derleth et al., "Modeling temporal and compressive properties of the normal and impaired auditory system", Hearing Research 159, 2001, pp. 132-149.
Inga Holube et al., "Speech intelligibility prediction in hearing-impaired listeners based on a psychoacoustically motivated perception model", J. Acoust. Soc. Am. 100 (3), Sep. 1996, pp. 1704-1716.
Reinier Plomp, "A Signal-To-Noise Ratio Model for the Speech-Reception Threshold of the Hearing Impaired", Journal of Speech and Hearing Research, vol. 29, Jun. 1986, pp. 146-154.
T. Houtgast et al., "The Modulation Transfer Function in Room Acoustics as a Predictor of Speech Intelligibility", Technical Notes and Research Briefs, The Journal of the Acoustical Society of America, p. 557.
Zhu Liu et al., "Audio Feature Extraction & Analysis for Scene Classification", IEEE, pp. 343-348.
Silvia Allegro et al., "Automatic Sound Classification Inspired by Auditory Scene Analysis", 4 pages.
Eric Allamanche et al., "Content-based Identification of Audio Material Using MPEG-7 Low Level Description", 8 pages.
Wu Chou et al., "Robust Singing Detection in Speech/Music Discriminator Design", IEEE, pp. 865-868.
Ronald M. Aarts et al., "A Real-Time Speech-Music Discriminator", J. Audio Eng. Soc., vol. 47, No. 9, Sep. 1999, pp. 720-725.
Shariq J. Rizvi et al., "MADClassifier: Content-Based Continuous Classification of Mixed Audio Data", Technical Report CS-2002-34, Oct. 2002, 12 pages.
John Saunders, "Real-Time Discrimination of Broadcast Speech/Music", IEEE, pp. 993-996.
Eric Sheirer et al., "Construction and Evaluation of a Robust Multifeature Speech/Music Discriminator", IEEE, 1997, pp. 1331-1334.
Savitha Srinivasan et al., "Towards Robust Features for Classifying Audio in the CueVideo System", IBM Almaden Research Center, ACM Multimedia, 1999, pp. 393-400.
Shin'Ichi Takeuchi et al., "Optimization of Voice/Music Detection in Sound Data", Graduate School of Computer Science and Engineering, University of Aizu, Japan, 4 pages.
George Tzanetakis et al., "Sound Analysis Using MPEG Compressed Audio", IEEE, 2000, pp. 761-764.
Tong Zhang et al., "Audio Content Analysis for Online Audiovisual Data Segmentation and Classification", IEEE Transactions of Speech and Audio Processing, vol. 9, No. 4, May 2001, pp. 441-457.
Michael J. Carey et al., "A Comparison of Features for Speech, Music Discrimination", Ensigma Ltd., IEEE, 1999, pp. 149-152.
Khaled El-Maleh et al., "Speech/Music Discrimination for Multimedia Applications", McGill University, IEEE, 2000, pp. 2445-2448.
Lie Lu et al., "A Robust Audio Classification and Segmentation Method", Microsoft research, China, 9 pages.
Alan Oppenheim et al. "Computation of Spectra with Unequal Resolution Using the Fast Fourier Transform", Proceedings Letters, Manuscript, Jun. 11, 1970, pp. 299-301.
Vesa Peltonen et al., "Computational Auditory Scene Recognition", IEEE, 2002, pp. 1941-1944.
Silvia Pfeiffer et al., "Automatic Audio Content Analysis", University of Mannheim, ACM Multimedia, 1996, pp. 21-30.
E. Zwicker et al., "Psychoacoustics: Facts and Models", Second Updated Edition, New York: Springer-Verlag Berlin Heidelberg, 1999, pp. 257-264.

* cited by examiner

| Number | Feature |
|---|---|
| 1 | Mean-Squared Signal Power |
| 2 | Standard Deviation of the Signal Envelope |
| 3 | Mel Cepstrum Coefficient 1 |
| 4 | Mel Cepstrum Coefficient 2 |
| 5 | Mel Cepstrum Coefficient 3 |
| 6 | Mel Cepstrum Coefficient 4 |
| 7 | Delta Cepstrum Coefficient 1 |
| 8 | Delta Cepstrum Coefficient 2 |
| 9 | Delta Cepstrum Coefficient 3 |
| 10 | Delta Cepstrum Coefficient 4 |
| 11 | Zero Crossing Rate (ZCR) |
| 12 | ZCR of the Signal 1$^{st}$ Difference |
| 13 | Standard Deviation of the ZCR |
| 14 | Power Spectrum Centroid |
| 15 | Delta Centroid |
| 16 | Standard Deviation of the Centroid |
| 17 | Power Spectrum Entropy |
| 18 | Broadband Envelope Correlation Lag |
| 19 | Broadband Envelope Correlation Peak |
| 20 | Four-Band Envelope Correlation Lag |
| 21 | Four-Band Envelope Correlation Peak |

Table 1.

Conventional signal features used for the sound classification.

Fig. 6

| Training Protocol | Test Protocol | Signal Class | | | |
|---|---|---|---|---|---|
| | | Speech | Music | Noise | Ave. |
| Conventional | | | | | |
| Separate Classes | Separate Classes | 98.6 | 92.0 | 95.8 | 95.4 |
| 2-Signal Mixture | Separate Classes | 98.1 | 91.4 | 86.4 | 91.9 |
| Separate Classes | 2-Signal Mixture | 83.7 | 81.3 | 86.6 | 83.6 |
| 2-Signal Mixture | 2-Signal Mixture | 85.4 | 82.0 | 80.6 | 82.7 |
| Histogram | | | | | |
| Separate Classes | Separate Classes | 99.6 | 99.3 | 99.0 | 99.3 |
| 2-Signal Mixture | Separate Classes | 99.6 | 98.3 | 95.1 | 97.7 |
| Separate Classes | 2-Signal Mixture | 79.0 | 88.2 | 84.8 | 84.0 |
| 2-Signal Mixture | 2-Signal Mixture | 86.8 | 91.8 | 86.2 | 88.3 |
| Hist + Temporal | | | | | |
| 2-Signal Mixture | 2-Signal Mixture | 87.3 | 91.2 | 86.2 | 88.2 |

Table 2

Percent correct identification of the signal class having the largest gain. Hist + Temporal combines the log-level histogram with the features relating to the signal zero-crossing rate and envelope periodicity (11-13 and 18-21).

Fig. 8

| Training Protocol | Test Protocol | Signal Class | | | |
|---|---|---|---|---|---|
| | | Speech | Music | Noise | Ave. |
| Conventional | | | | | |
| Separate Classes | 2-Signal Mixture | 23.3 | 42.4 | 71.5 | 45.7 |
| 2-Signal Mixture | 2-Signal Mixture | 46.2 | 44.8 | 53.4 | 48.1 |
| Histogram | | | | | |
| Separate Classes | 2-Signal Mixture | 16.3 | 54.3 | 68.6 | 46.4 |
| 2-Signal Mixture | 2-Signal Mixture | 56.6 | 47.4 | 58.4 | 54.1 |
| Hist + Temporal | | | | | |
| 2-Signal Mixture | 2-Signal Mixture | 58.6 | 48.0 | 55.9 | 54.2 |

Table 3

Percent correct identification of the weaker signal class of the two-signal mixture. Hist + Temporal combines the log-level histogram with the features relating to the signal zero-crossing rate and envelope periodicity (11-13 and 18-21).

Fig. 9

| Training Protocol | Test Protocol | Signal Class | | | |
|---|---|---|---|---|---|
| | | Speech | Music | Noise | Ave. |
| Conventional | | | | | |
| Separate Classes | 2-Signal Mixture | 78.8 | 57.5 | 18.2 | 51.5 |
| 2-Signal Mixture | 2-Signal Mixture | 56.3 | 63.3 | 47.6 | 55.7 |
| Histogram | | | | | |
| Separate Classes | 2-Signal Mixture | 85.4 | 38.9 | 23.4 | 49.2 |
| 2-Signal Mixture | 2-Signal Mixture | 62.8 | 66.9 | 56.1 | 61.9 |
| Hist + Temporal | | | | | |
| 2-Signal Mixture | 2-Signal Mixture | 61.2 | 67.5 | 58.0 | 62.2 |

Table 4

Percent correct identification of the signal class not included in the two-signal mixture. Hist + Temporal combines the log-level histogram with the features relating to the signal zero-crossing rate and envelope periodicity (11-13 and 18-21).

Fig. 10

| Feature Set | Signal Class | | | |
|---|---|---|---|---|
| | Speech | Music | Noise | Average |
| Histogram | 86.8 | 91.8 | 86.2 | 88.3 |
| Normalized Histogram | 82.6 | 69.9 | 77.5 | 76.7 |
| Envelope Modulation | 80.6 | 81.1 | 77.5 | 79.8 |
| Histogram + Env Mod | 88.4 | 92.1 | 87.4 | 89.3 |
| Norm Hist + Env Mod | 86.9 | 81.2 | 83.0 | 83.7 |

Table 1. Percent correct identification of the signal class having the larger gain in the two-signal mixture.

Fig. 17

| Feature Set | Signal Class | | | |
|---|---|---|---|---|
| | Speech | Music | Noise | Average |
| Histogram | 56.6 | 47.4 | 58.4 | 54.1 |
| Normalized Histogram | 37.9 | 49.8 | 49.0 | 45.6 |
| Envelope Modulation | 43.4 | 47.0 | 50.7 | 47.0 |
| Histogram + Env Mod | 58.0 | 49.8 | 59.7 | 55.9 |
| Norm Hist + Env Mod | 45.4 | 52.1 | 51.4 | 49.6 |

Table 2. Percent correct identification of the signal class having the smaller gain in the two-signal mixture.

Fig. 18

| Feature Set | Signal Class | | | |
|---|---|---|---|---|
| | Speech | Music | Noise | Average |
| Histogram | 62.8 | 66.9 | 56.1 | 61.9 |
| Normalized Histogram | 67.9 | 53.0 | 51.1 | 57.3 |
| Envelope Modulation | 61.9 | 54.4 | 53.6 | 56.6 |
| Histogram + Env Mod | 64.9 | 68.5 | 56.9 | 63.4 |
| Norm Hist + Env Mod | 63.6 | 58.7 | 55.3 | 59.2 |

Table 3. Percent correct identification of the signal class not included in the two-signal mixture.

Fig. 19

HEARING AID WITH HISTOGRAM BASED SOUND ENVIRONMENT CLASSIFICATION

RELATED APPLICATION DATA

This application is the national stage of International Application No. PCT/DK2007/000393, filed on Sep. 4, 2007, which claims priority to and the benefit of Denmark Patent Application No. PA 2006 01140, filed on Sep. 5, 2006, and U.S. Provisional Patent Application No. 60/842,590, filed on Sep. 5, 2006, the entire disclosure of all of which is expressly incorporated by reference herein.

FIELD

The present application relates to a hearing aid with a sound classification capability.

BACKGROUND & SUMMARY

Today's conventional hearing aids typically comprise a Digital Signal Processor (DSP) for processing of sound received by the hearing aid for compensation of the user's hearing loss. As is well known in the art, the processing of the DSP is controlled by a signal processing algorithm having various parameters for adjustment of the actual signal processing performed.

The flexibility of the DSP is often utilized to provide a plurality of different algorithms and/or a plurality of sets of parameters of a specific algorithm. For example, various algorithms may be provided for noise suppression, i.e. attenuation of undesired signals and amplification of desired signals. Desired signals are usually speech or music, and undesired signals can be background speech, restaurant clatter, music (when speech is the desired signal), traffic noise, etc.

The different algorithms and parameter sets are typically included to provide comfortable and intelligible reproduced sound quality in different sound environments, such as speech, babble speech, restaurant clatter, music, traffic noise, etc. Audio signals obtained from different sound environments may possess very different characteristics, e.g. average and maximum sound pressure levels (SPLs) and/or frequency content. Therefore, in a hearing aid with a DSP, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Consequently, today's DSP based hearing aids are usually provided with a number of different programs, each program tailored to a particular sound environment class and/or particular user preferences. Signal processing characteristics of each of these programs is typically determined during an initial fitting session in a dispenser's office and programmed into the hearing aid by activating corresponding algorithms and algorithm parameters in a non-volatile memory area of the hearing aid and/or transmitting corresponding algorithms and algorithm parameters to the non-volatile memory area.

Some known hearing aids are capable of automatically classifying the user's sound environment into one of a number of relevant or typical everyday sound environment classes, such as speech, babble speech, restaurant clatter, music, traffic noise, etc.

Obtained classification results may be utilised in the hearing aid to automatically select signal processing characteristics of the hearing aid, e.g. to automatically switch to the most suitable algorithm for the environment in question. Such a hearing aid will be able to maintain optimum sound quality and/or speech intelligibility for the individual hearing aid user in various sound environments.

U.S. Pat. No. 5,687,241 discloses a multi-channel DSP based hearing aid that utilises continuous determination or calculation of one or several percentile values of input signal amplitude distributions to discriminate between speech and noise input signals. Gain values in each of a number of frequency channels are adjusted in response to detected levels of speech and noise.

However, Applicant determines that it may be desirable to provide a more subtle characterization of a sound environment than only discriminating between speech and noise. As an example, it may be desirable to switch between an omni-directional and a directional microphone preset program in dependence of, not just the level of background noise, but also on further signal characteristics of this background noise. In situations where the user of the hearing aid communicates with another individual in the presence of the background noise, it would be beneficial to be able to identify and classify the type of background noise. Omni-directional operation could be selected in the event that the noise being traffic noise to allow the user to clearly hear approaching traffic independent of its direction of arrival. If, on the other hand, the background noise was classified as being babble-noise, the directional listening program could be selected to allow the user to hear a target speech signal with improved signal-to-noise ratio (SNR) during a conversation.

Applying Hidden Markov Models for analysis and classification of the microphone signal may obtain a detailed characterisation of e.g. a microphone signal. Hidden Markov Models are capable of modelling stochastic and non-stationary signals in terms of both short and long time temporal variations. Hidden Markov Models have been applied in speech recognition as a tool for modelling statistical properties of speech signals. The article "A Tutorial on Hidden Markov Models and Selected Applications in Speech Recognition", published in Proceedings of the IEEE, VOL 77, No. 2, February 1989 contains a comprehensive description of the application of Hidden Markov Models to problems in speech recognition.

WO 01/76321 discloses a hearing aid that provides automatic identification or classification of a sound environment by applying one or several predetermined Hidden Markov Models to process acoustic signals obtained from the listening environment. The hearing aid may utilise determined classification results to control parameter values of a signal processing algorithm or to control switching between different algorithms so as to optimally adapt the signal processing of the hearing aid to a given sound environment.

US 2004/0175008 discloses formation of a histogram from signals which are indicative of direction of arrival (DOA) of signals received at a hearing aid in order to control signal processing parameters of the hearing aid.

The formed histogram is classified and different control signals are generated in dependency of the result of such classifying.

The histogram function is classified according to at least one of the following aspects:

1) how is the angular location and/or its evolution of an acoustical source with respect to the hearing device and/or with respect to other sources, 2) what is the distance and/or its evolution of an acoustical source with respect to the device and/or with respect to other acoustical sources,
3) which is the significance of an acoustical source with respect to other acoustical sources, and
4) how is the angular movement of the device itself and thus of the individual with respect to the acoustical surrounding and thus to acoustical sources.

Classification of the sound environment into a number of environmental classes, such as speech, babble speech, restaurant clatter, music, traffic noise, etc., is not mentioned in US 2004/0175008.

Applicant determines that it may be desirable to provide an alternative method in a hearing aid of classifying the sound environment into a number of environmental classes, such as speech, babble speech, restaurant clatter, music, traffic noise, etc.

According to some embodiments, this and other objects are obtained by provision of a hearing aid comprising a microphone and an A/D converter for provision of a digital input signal in response to sound signals received at the respective microphone in a sound environment, a processor that is adapted to process the digital input signals in accordance with a predetermined signal processing algorithm to generate a processed output signal, and a sound environment detector for determination of the sound environment of the hearing aid based on the digital input signal and providing an output for selection of the signal processing algorithm generating the processed output signal, the sound environment detector including a feature extractor for determination of histogram values of the digital input signal in a plurality of frequency bands, an environment classifier adapted for classifying the sound environment into a number of environmental classes based on the determined histogram values from at least two frequency bands, and a parameter map for the provision of the output for selection of the signal processing algorithm, and a D/A converter and an output transducer for conversion of the respective processed sound signal to an acoustic output signal.

A histogram is a function that counts the number—$n_i$—of observations that falls into various disjoint categories—i—known as bins. Thus, if N is the total number of observations and B is the total number of bins, the number of observations—$n_i$—fulfils the following equation:

$$N = \sum_{i=1}^{B} n_i.$$

For example, the dynamic range of a signal may be divided into a number of bins usually of the same size, and the number of signal samples falling within each bin may be counted thereby forming the histogram. The dynamic range may also be divided into a number of bins of the same size on a logarithmic scale. The number of samples within a specific bin is also termed a bin value or a histogram value or a histogram bin value. Further, the signal may be divided into a number of frequency bands and a histogram may be determined for each frequency band. Each frequency band may be numbered with a frequency band index also termed a frequency bin index. For example, the histogram bin values of a dB signal level histogram may be given by h(j,k) where j is the histogram dB level bin index and k is the frequency band index or frequency bin index. The frequency bins may range from 0 Hz-20 kHz, and the frequency bin size may be uneven and chosen in such a way that it approximates the Bark scale.

The feature extractor may not determine all histogram bin values h(j,k) of the histogram, but it may be sufficient to determine some of the histogram bin values. For example, it may be sufficient for the feature extractor to determine every second signal level bin value.

The signal level values may be stored on a suitable data storage device, such as a semiconductor memory in the hearing aid. The stored signal level values may be read from the data storage device and organized in selected bins and input to the classifier.

In accordance with some embodiments, a hearing aid includes a microphone and an A/D converter for provision of a digital input signal in response to a sound signal received at the microphone in a sound environment, a processor that is configured to process the digital input signal in accordance with a signal processing algorithm to generate a processed output signal, a sound environment detector for determination of the sound environment based at least in part on the digital input signal, and for providing an output for selection of the signal processing algorithm, the sound environment detector including (1) a feature extractor for determination of histogram values of the digital input signal in a plurality of frequency bands, (2) an environment classifier configured for classifying the sound environment into a number of environmental classes based at least in part on the determined histogram values from at least two of the plurality of frequency bands, and (3) a parameter map for the provision of the output for the selection of the signal processing algorithm, and a D/A converter and an output transducer for conversion of the processed output signal to an acoustic output signal.

In accordance with other embodiments, a hearing aid includes a sound environment detector for determination of a sound environment, the sound environment detector comprising a feature extractor for determination of histogram values of a digital input signal in a plurality of frequency bands, an environment classifier configured for classifying the sound environment into a number of environmental classes based at least in part on the histogram values from at least two of the plurality of frequency bands, and a parameter map for the provision of an output for the selection of a signal processing algorithm for a processor.

DESCRIPTION OF THE DRAWING FIGURES

Figure 2:
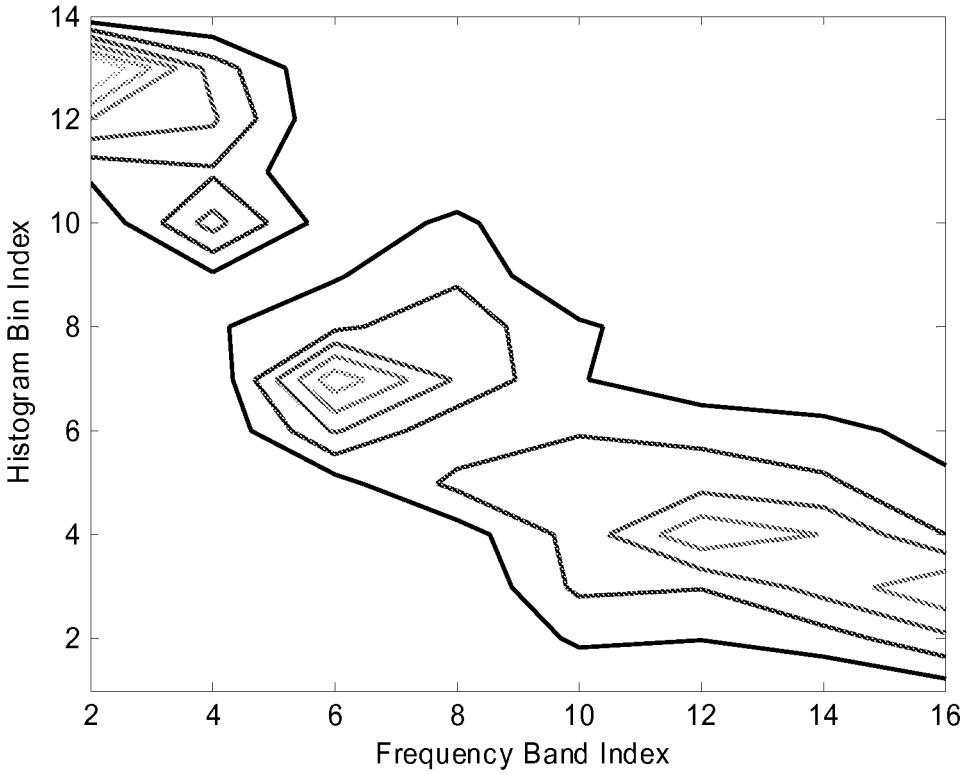
Figure 3:
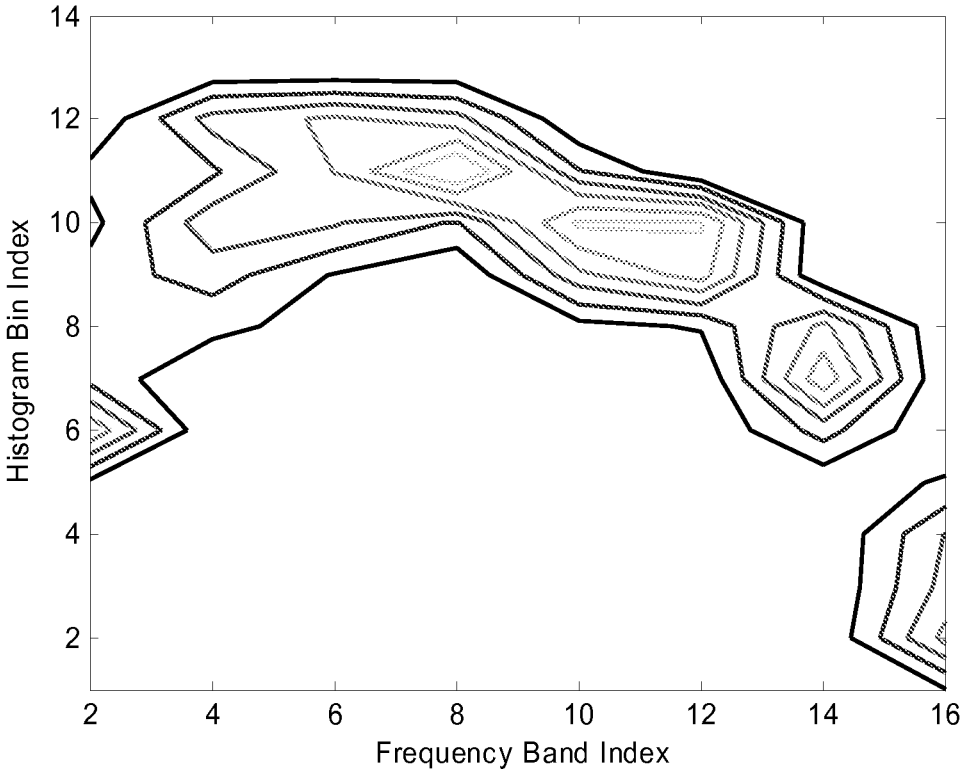
Figure 4:
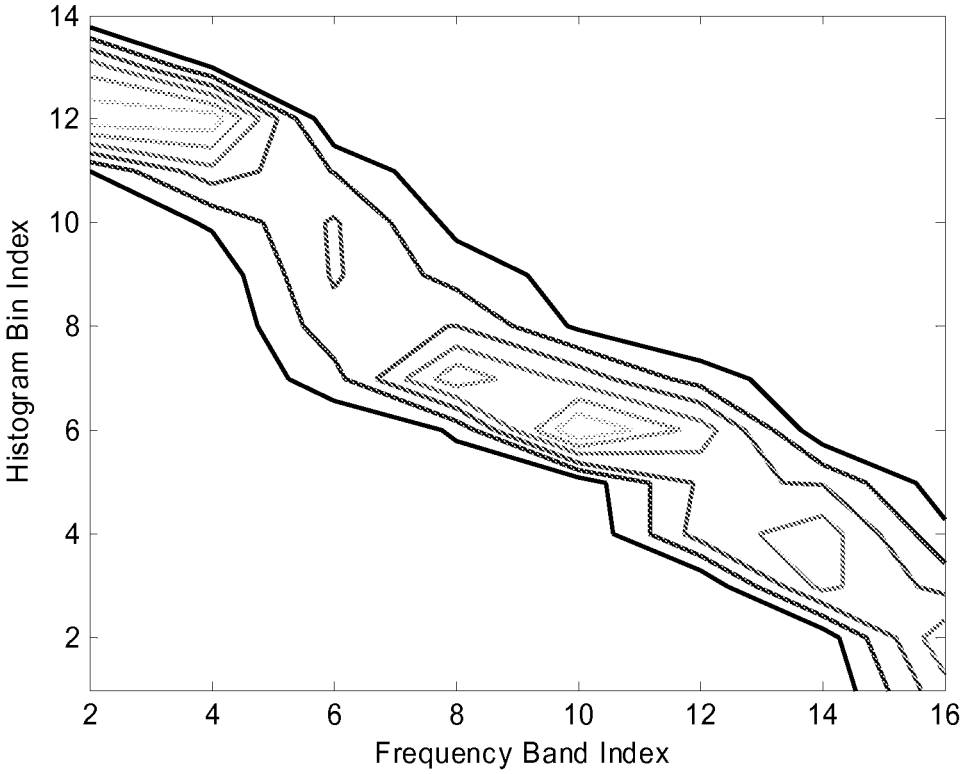
Figure 5:
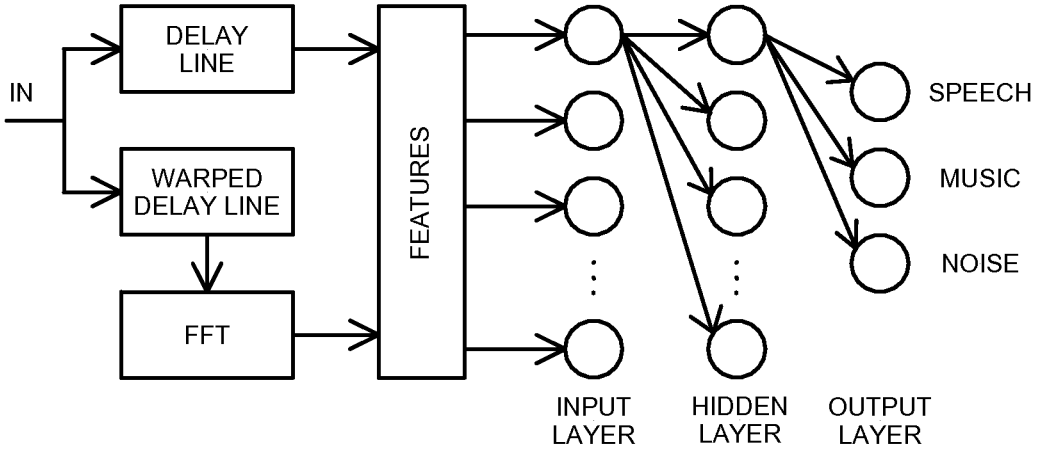
Figure 7:
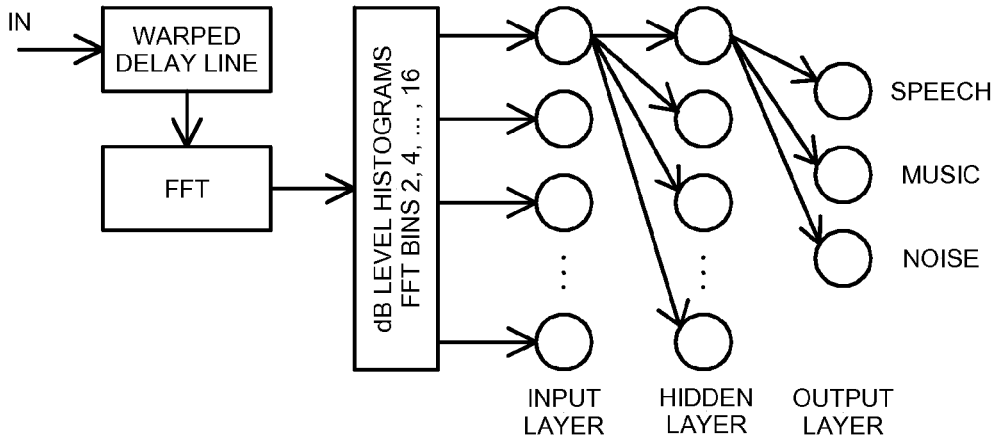
Figure 11:
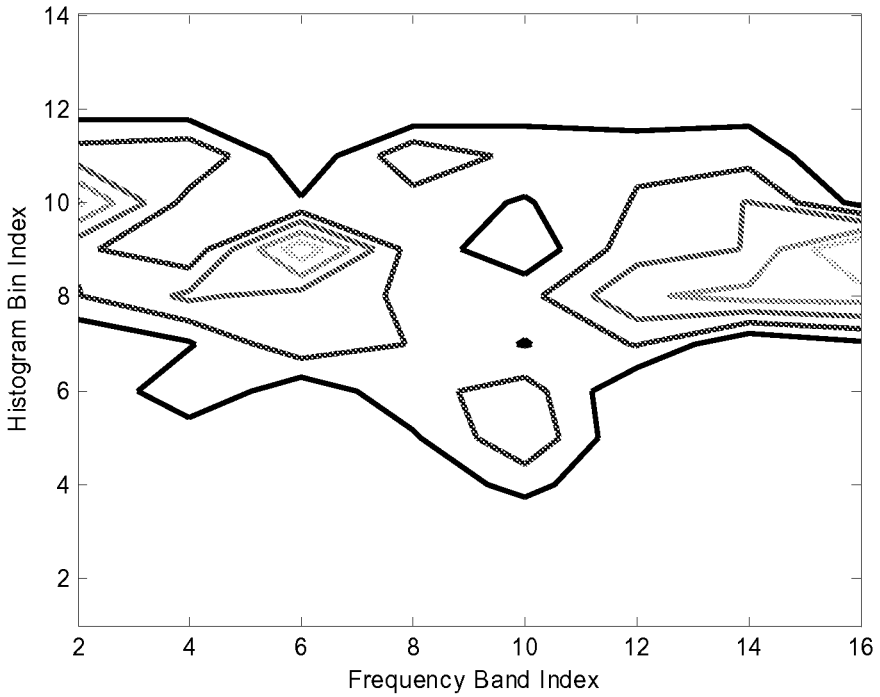
Figure 12:
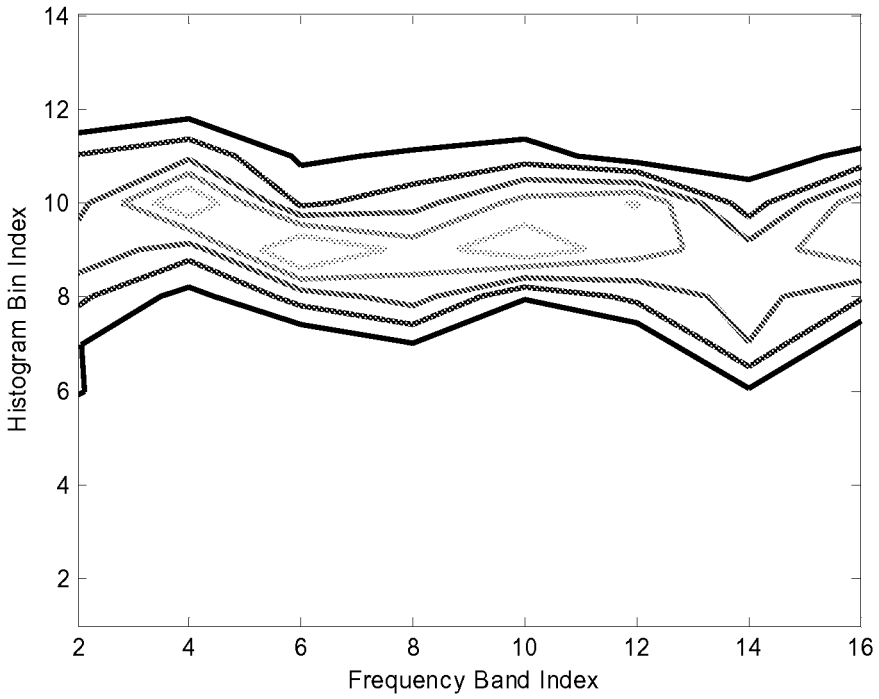
Figure 13:
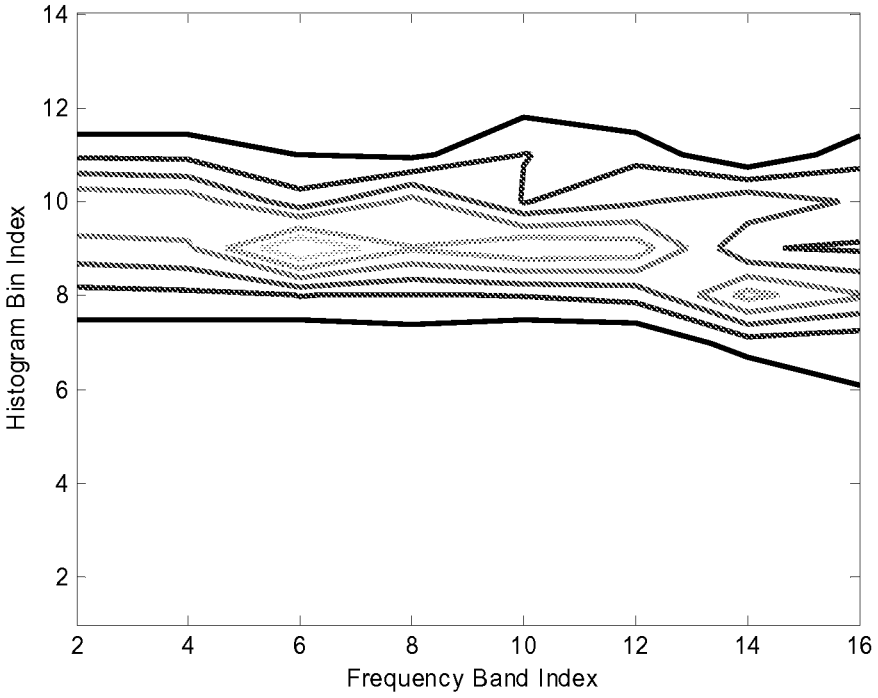
Figure 14:
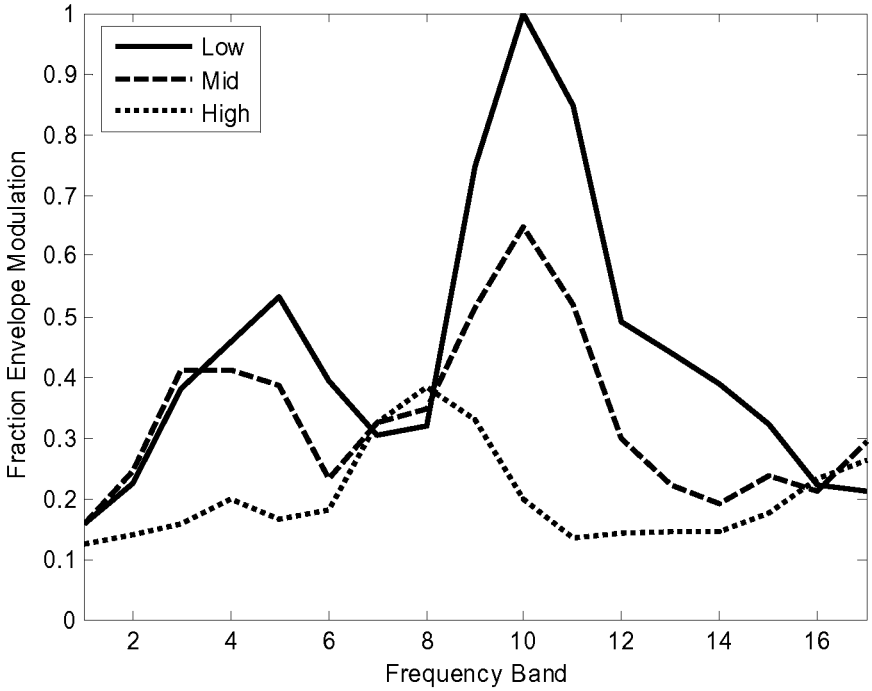
Figure 15:
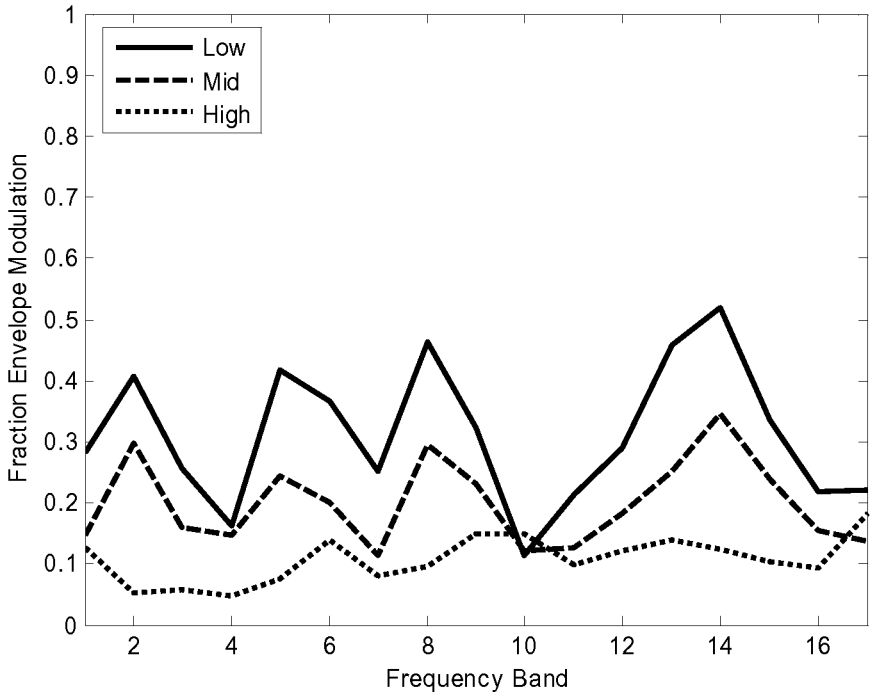
Figure 16:
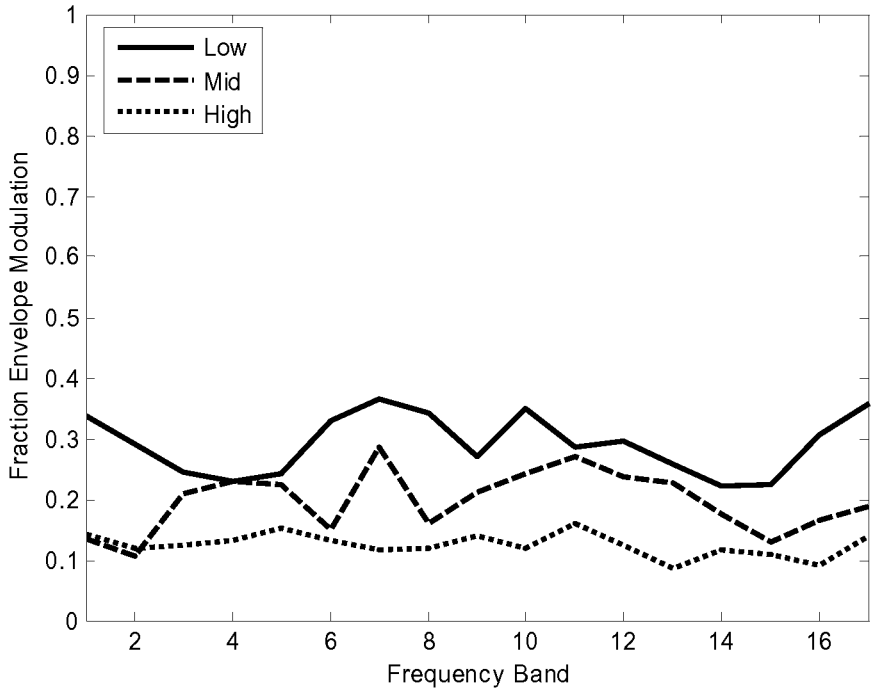

For a better understanding of the embodiments, reference will now be made, by way of example, to the accompanying drawings, in which:

FIG. 1 illustrates schematically a prior art hearing aid with sound environment classification, FIG. 2 is a plot of a log-level histogram for a sample of speech, FIG. 3 is a plot of a log-level histogram for a sample of classical music, FIG. 4 is a plot of a log-level histogram for a sample of traffic noise, FIG. 5 is block diagram of a neural network classifier used for classification of the sound environment based on conventional signal features, FIG. 6 shows Table 1 of the conventional features used as an input to the neural network of FIG. 5, FIG. 7 is a block diagram of a neural network classifier according to some embodiments, FIG. 8 shows Table 2 of the percentage correct identification of the strongest signal, FIG. 9 shows Table 3 of the percentage correct identification of the weakest signal, FIG. 10 shows Table 4 of the percentage correct identification of a signal not present, FIG. 11 is a plot of a normalized log-level histogram for the sample of speech also used for FIG. 1, FIG. 12 is a plot of a normalized log-level histogram for a sample of classical music also used for FIG. 1, FIG. 13 is a plot of a normalized log-level histogram for a sample of traffic noise also used for FIG. 1, FIG. 14 is a plot of envelope modulation detection for the sample of speech also used for FIG. 1, FIG. 15 is a plot of a envelope modulation detection for the sample of classical music also used for FIG. 1, FIG. 16 is a plot of envelope modulation detection for the sample of traffic noise also used for FIG. 1, FIG. 17 shows table 5 of the percent correct identification of the signal class having the larger gain in the two-signal mixture, FIG. 18 shows table 6 of the percent correct identification of the signal class having the smaller gain in the two-signal mixture, and FIG. 19 shows table 7 of the percent correct identification of the signal class not included in the two-signal mixture.

DETAIL DESCRIPTION

The embodiments will now be described more fully hereinafter with reference to the accompanying drawings. The embodiments may, however, be embodied in different forms and should not be construed as limited to the embodiments set forth herein. Like reference numerals refer to like elements throughout. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 illustrates schematically a hearing aid 10 with sound environment classification according to some embodiments.

The hearing aid 10 comprises a first microphone 12 and a first A/D converter (not shown) for provision of a digital input signal 14 in response to sound signals received at the microphone 12 in a sound environment, and a second microphone 16 and a second A/D converter (not shown) for provision of a digital input signal 18 in response to sound signals received at the microphone 16, a processor 20 that is adapted to process the digital input signals 14, 18 in accordance with a predetermined signal processing algorithm to generate a processed output signal 22, and a D/A converter (not shown) and an output transducer 24 for conversion of the respective processed sound signal 22 to an acoustic output signal.

The hearing aid 10 further comprises a sound environment detector 26 for determination of the sound environment surrounding a user of the hearing aid 10. The determination is based on the signal levels of the output signals of the microphones 12, 16. Based on the determination, the sound environment detector 26 provides outputs 28 to the hearing aid processor 20 for selection of the signal processing algorithm appropriate in the determined sound environment. Thus, the hearing aid processor 20 is automatically switched to the most suitable algorithm for the determined environment whereby optimum sound quality and/or speech intelligibility is maintained in various sound environments.

The signal processing algorithms of the processor 20 may perform various forms of noise reduction and dynamic range compression as well as a range of other signal processing tasks.

In a conventional hearing aid, the sound environment detector 26 comprises a feature extractor 30 for determination of characteristic parameters of the received sound signals. The feature extractor 30 maps the unprocessed sound inputs 14, 18 into sound features, i.e. the characteristic parameters. These features can be signal power, spectral data and other well-known features.

However, according to some embodiments, the feature extractor 30 is adapted to determine a histogram of signal levels, preferably logarithmic signal levels, in a plurality of frequency bands.

The logarithmic signal levels are preferred so that the large dynamic range of the input signal is divided into a suitable number of histogram bins. The non-linear logarithmic function compresses high signal levels and expands low signal levels leading to excellent characterisation of low power signals. Other non-linear functions of the input signal levels that expand low level signals and compress high level signals may also be utilized, such as a hyperbolic function, the square root or another n'th power of the signal level where $n<1$, etc.

The sound environment detector 26 further comprises an environment classifier 32 for classifying the sound environment based on the determined signal level histogram values. The environment classifier classifies the sounds into a number of environmental classes, such as speech, babble speech, restaurant clatter, music, traffic noise, etc. The classification process may comprise a simple nearest neighbour search, a neural network, a Hidden Markov Model system, a support vector machine (SVM), a relevance vector machine (RVM), or another system capable of pattern recognition, either alone or in any combination. The output of the environmental classification can be a "hard" classification containing one single environmental class, or, a set of probabilities indicating the probabilities of the sound belonging to the respective classes. Other outputs may also be applicable.

The sound environment detector 26 further comprises a parameter map 34 for the provision of outputs 28 for selection of the signal processing algorithms and/or selection of appropriate parameter values of the operating signal processing algorithm.

Most sound classification systems are based on the assumption that the signal being classified represents just one class. For example, if classification of a sound as being speech or music is desired, the usual assumption is that the signal present at any given time is either speech or music and not a combination of the two. In most practical situations, however, the signal is a combination of signals from different classes. For example, speech in background noise is a common occurrence, and the signal to be classified is a combination of signals from the two classes of speech and noise. Identifying a single class at a time is an idealized situation, while combinations represent the real world. The objective of the sound classifier in a hearing aid is to determine which classes are present in the combination and in what proportion.

The major sound classes for a hearing aid may for example be speech, music, and noise. Noise may be further subdivided into stationary or non-stationary noise. Different processing parameter settings may be desired under different listening conditions. For example, subjects using dynamic-range compression tend to prefer longer release time constants and lower compression ratios when listening in multi-talker babble at poor signal-to-noise ratios.

The signal features used for classifying separate signal classes are not necessarily optimal for classifying combinations of sounds. In classifying a combination, information about both the weaker and stronger signal components are needed, while for separate classes all information is assumed to relate to the stronger component. According to a preferred embodiment, a new classification approach based on using the log-level signal histograms, preferably in non-overlapping frequency bands, is provided.

The histograms include information about both the stronger and weaker signal components present in the combination. Instead of extracting a subset of features from the histograms, they are used directly as the input to a classifier, preferably a neural network classifier.

The frequency bands may be formed using digital frequency warping. Frequency warping uses a conformal mapping to give a non-uniform spacing of frequency samples around the unit circle in the complex-z plane (Oppenheim, A. V., Johnson, D. H., and Steiglitz, K. (1971), "Computation of spectra with unequal resolution using the fast Fourier transform", Proc. IEEE, Vol. 59, pp 299-300; Smith, J. O., and Abel, J. S. (1999), "Bark and ERB bilinear transforms", IEEE Trans. Speech and Audio Proc., Vol. 7, pp 697-708; Härmä, A., Karjalainen, M., Savioja, L., Välimäki, V., Laine, U. K., Huopaniemi, J. (2000), "Frequency-warped signal processing for audio applications," J. Audio Eng. Soc., Vol. 48, pp. 1011-1031). Digital frequency warping is achieved by replacing the unit delays in a digital filter with first-order all-pass filters. The all-pass filter is given by $$A(z) = \frac{z^{-1} - a}{1 - az^{-1}} \tag{1}$$

where a is the warping parameter. With an appropriate choice of the parameters governing the conformal mapping (Smith, J. O., and Abel, J. S. (1999), "Bark and ERB bilinear transforms", IEEE Trans. Speech and Audio Proc., Vol. 7, pp 697-708), the reallocation of frequency samples comes very close to the Bark (Zwicker, E., and Terhardt, E. (1980), "Analytical expressions for critical-band rate and critical bandwidth as a function of frequency", J. Acoust. Soc. Am., Vol. 68, pp 1523-1525) or ERB (Moore, B. C. J., and Glasberg, B. R. (1983), "Suggested formulae for calculating auditory-filter bandwidths and excitation patterns", J. Acoust. Soc. Am., Vol. 74, pp 750-753) frequency scales used to describe the auditory frequency representation. Frequency warping therefore allows the design of hearing aid processing (Kates, J. M. (2003), "Dynamic-range compression using digital frequency warping", Proc. 37$^{th}$ Asilomar Conf. on Signals, Systems, and Computers, Nov. 9-12, 2003, Asilomar Conf. Ctr., Pacific Grove, Calif.; Kates, J. M., and Arehart, K. H. (2005), "Multi-channel dynamic-range compression using digital frequency warping", to appear in EURASIP J. Appl. Sig. Proc.) and digital audio systems (Härmä, A., Karjalainen, M., Savioja, L., Välimäki, V., Laine, U.K., Huopaniemi, J. (2000), "Frequency-warped signal processing for audio applications," J. Audio Eng. Soc., Vol. 48, pp. 1011-1031) that have uniform time sampling but which have a frequency representation similar to that of the human auditory system.

A further advantage of the frequency warping is that higher resolution at lower frequencies is achieved. Additionally, fewer calculations are needed since a shorter FFT may be used, because only the hearing relevant frequencies are used in the FFT. This implies that the time delay in the signal processing of the hearing aid will be shortened, because shorter blocks of time samples may be used than for non-warped frequency bands.

In some embodiments, the frequency warping is realized by a cascade of 31 all-pass filters using a=0.5. The frequency analysis is then realized by applying a 32-point FFT to the input and 31 outputs of the cascade. This analysis gives 17 positive frequency bands from 0 through p, with the band spacing approximately 170 Hz at low frequencies and increasing to 1300 Hz at high frequencies. The FFT outputs were computed once per block of 24 samples.

Conventionally, histograms have been used to give an estimate of the probability distribution of a classifier feature. Histograms of the values taken by different features are often used as the inputs to Bayesian classifiers (MacKay, D. J. C. (2003), *Information Theory, Inference, and Learning Algorithms*, New York: Cambridge U. Press), and can also be used for other classifier strategies. For sound classification using a hidden Markov model (HMM), for example, Allegro, S., Büchler, M., and Launer, S. (2001), "Automatic sound classification inspired by auditory scene analysis", Proc. CRAC, Sep. 2, 2001, Aalborg, Denmark, proposed using two features extracted from the histogram of the signal level samples in dB. The mean signal level is estimated as the 50 percent point of the cumulative histogram, and the signal dynamic range as the distance from the 10 percent point to the 90 percent point. In Ludvigsen, C. (1997), "Schaltungsanordnung für die automatische regelung von hörhilfsgeräten", Patent DE 59402853D, issued Jun. 26, 1997 it has also been proposed using the overall signal level histogram to distinguish between continuous and impulsive sounds.

According to some embodiments, histogram values in a plurality of frequency bands are utilized as the input to the environment classifier, and in a preferred embodiment, the supervised training procedure extracts and organizes the information contained in the histogram.

In one embodiment, the number of inputs to the classifier is equal to the number of histogram bins at each frequency band times the number of frequency bands. The dynamic range of the digitized hearing-aid signal is approximately 60 dB; the noise floor is about 25 dB SPL, and the A/D converter tends to saturate at about 85 dB SPL (Kates, J. M. (1998), "Signal processing for hearing aids", in *Applications of Signal Processing to Audio and Acoustics*, Ed. by M. Kahrs and K. Brandenberg, Boston: Kluwer Academic Pub., pp 235-277). Using an amplitude bin width of 3 dB thus results in 21 log level histogram bins. The Warp-31 compressor (Kates, J. M. (2003), "Dynamic-range compression using digital frequency warping", Proc. 37$^{th}$ Asilomar Conf. on Signals, Systems, and Computers, Nov. 9-12, 2003, Asilomar Conf. Ctr., Pacific Grove, Calif.; Kates, J. M., and Arehart, K. H. (2005), "Multi-channel dynamic-range compression using digital frequency warping", to appear in EURASIP J. Appl. Sig. Proc.) produces 17 frequency bands covering the range from 0 to p. The complete set of histograms would therefore require 21×17=357 values.

In other embodiments, the histogram values represent the time during which the signal levels reside within a corresponding signal level range determined within a certain time frame, such as the sample period, i.e. the time for one signal sample. A histogram value may be determined by adding the newest result from the recent time frame to the previous sum. Before adding the result of a new time frame to the previous sum, the previous sum may be multiplied by a memory factor that is less than one preventing the result from growing towards infinity and whereby the influence of each value decreases with time so that the histogram reflects the recent history of the signal levels. Alternatively, the histogram values may be determined by adding the result of the most recent N time frames.

In this embodiment, the histogram is a representation of a probability density function of the signal level distribution.

For example, for a histogram with level bins that are 3 dB wide, the first bin ranges from 25-27 dB SPL (the noise floor is chosen to be 25 dB); the second bin ranges from 28-30 dB SPL, and so on. An input sample with a signal level of 29.7 dB SPL leads to the incrementation of the second histogram bin. Continuation of this procedure would eventually lead to infinite histogram values and therefore, the previous histogram value is multiplied by a memory factor less than one before adding the new sample count.

In another embodiment, the histogram is calculated to reflect the recent history of the signal levels. According to this procedure, the histogram is normalized, i.e. the content of each bin is normalized with respect to the total content of all the bins. When the histogram is updated, the content of every bin is multiplied by a number b that is slightly less than 1. This number, b, functions as a forgetting factor so that previous contributions to the histogram slowly decay and the most recent inputs have the greatest weight. Then the contents of the bin, for example bin 2, corresponding to the current signal level is incremented by (1−b) whereby the contents of all of the bins in the histogram (i.e. bin 1 contents+bin 2 contents+ . . . ) sum to 1, and the normalized histogram can be considered to be the probability density function of the signal level distribution.

In a preferred embodiment, the signal level in each frequency band is normalized by the total signal power. This removes the absolute signal level as a factor in the classification, thus ensuring that the classifier is accurate for any input signal level, and reduces the dynamic range to be recorded in each band to 40 dB. Using an amplitude bin width of 3 dB thus results in 14 log level histogram bins.

In one embodiment, only every other frequency band is used for the histograms. Windowing in the frequency bands may reduce the frequency resolution and thus, the windowing smoothes the spectrum, and it can be subsampled by a factor of two without losing any significant information. In the above-mentioned embodiment, the complete set of histograms therefore requires 14×8=112 values, which is 31 percent of the original number.

Examples of log-level histograms are shown in FIGS. 2-4. FIG. 2 shows a histogram for a segment of speech. The frequency band index runs from 1 (0 Hz) to 17 (8 kHz), and only the even-numbered bands are plotted. The histogram bin index runs from 1 to 14, with bin 14 corresponding to 0 dB (all of the signal power in one frequency band), and the bin width is 3 dB. The speech histogram shows a peak at low frequencies, with reduced relative levels combined with a broad level distribution at high frequencies. FIG. 3 shows a histogram for a segment of classical music. The music histogram shows a peak towards the mid frequencies and a relatively narrow level distribution at all frequencies. FIG. 4 shows a histogram for a segment of traffic noise. Like the speech example, the noise has a peak at low frequencies. However, the noise has a narrow level distribution at high frequencies while the speech had a broad distribution in this frequency region.

A block diagram of a neural network classifier used for classification of the sound environment based on conventional signal features is shown in FIG. 5. The neural network was implemented using the MATLAB Neural Network Toolbox (Demuth, H., and Beale, M. (2000), *Neural Network Toolbox for Use with MATLAB: Users' Guide Version* 4, Natick, Mass.: The MathWorks, Inc.).

The hidden layer consisted of 16 neurons. The neurons in the hidden layer connect to the three neurons in the output layer. The log-sigmoid transfer function was used between the input and hidden layers, and also between the hidden and output layers. Training used the resilient back propagation algorithm, and 150 training epochs were used.

In the embodiment shown in FIG. 7, the environment classifier includes a neural network. The network uses continuous inputs and supervised learning to adjust the connections between the input features and the output sound classes. A neural network has the additional advantage that it can be trained to model a continuous function. In the sound classification system, the neural network can be trained to represent the fraction of the input signal power that belongs to the different classes, thus giving a system that can describe a combination of signals.

The classification is based on the log-level histograms. The hidden layer consisted of 8 neurons. The neurons in the hidden layer connect to the three neurons in the output layer. The log-sigmoid transfer function was used between the input and hidden layers, and also between the hidden and output layers. Training used the resilient back propagation algorithm, and 150 training epochs were used.

Below the classification results obtained with conventional features processed with the neural network shown in FIG. 5 are compared with the classification performed by the embodiment shown in FIG. 7.

Conventionally, many signal features have been proposed for classifying sounds. Typically a combination of features is used as the input to the classification algorithm. In this study, the classification accuracy using histograms of the signal magnitude in dB in separate frequency bands is compared to the results using a set of conventional features. The conventional features chosen for this study are listed in Table 1 of FIG. 6. The signal processing used to extract each conventional feature is described in detail in Appendix A. The log-level histogram is described later in this section, and the signal processing used for the histogram is described in Appendix B. For all features, the signal sampling rate is 16 kHz. The signal processing uses a block size of 24 samples, which gives a block sampling rate of 667 Hz. For all of the features, the block outputs are combined into groups of 8 blocks, which results in a feature sampling period of 12 ms and a corresponding sampling rate of 83 Hz.

The first two conventional features are based on temporal characteristics of the signal. The mean-squared signal power (Pfeiffer, S., Fischer, S., and Effelsberg, W. (1996), "Automatic audio content analysis", Tech. Report TR-96-008, Dept. Math. And Comp. Sci., U. Mannheim, Germany; Liu, Z., Huang, J., Wang, Y., and Chen, T. (1997), "Audio feature extraction and analysis for scene classification", Proc. IEEE 1st Multimedia Workshop; Srinivasan, S., Petkovic, D., and Ponceleon, D. (1999), "Towards robust features for classifying audio in the CueVideo system", Proc. 7th ACM Conf. on Multimedia, pp 393-400; Allamanche, E., Herre, J., Hellmuth, O., Fröba, B., Kastner, T., and Cremer, M. (2001), "Content-based identification of audio material using MPEG-7 low level description", In *Proceedings of the Second Annual International Symposium on Music Information Retrieval*, Ed. by J. S. Downie and D. Bainbridge, Ismir, 2001, pp 197-204; Zhang, T., and Kuo, C.-C. (2001), "Audio content analysis for online audiovisual data segmentation and classification", IEEE Trans. Speech and Audio Proc., Vol. 9, pp 441-457; Peltonen, V., Tuomi, J., Klapuri, A., Huopaniemi, J., and Sorsa, T. (2002), "Computational auditory scene recognition", Proc. ICASSP 2002, Orlando, Fla., Vol. II, pp 1941-1944) measures the energy in each group of blocks. The fluctuation of the energy from group to group is represented by the standard deviation of the signal envelope, which is related to the variance of the block energy used by several researchers (Pfeiffer, S., Fischer, S., and Effelsberg, W. (1996), "Automatic audio content analysis", Tech. Report TR-96-008, Dept. Math. And Comp. Sci., U. Mannheim, Germany; Liu, Z., Huang, J., Wang, Y., and Chen, T. (1997), "Audio feature extraction and analysis for scene classification", Proc. IEEE 1st Multimedia Workshop; Srinivasan, S. Petkovic, D., and Ponceleon, D. (1999), "Towards robust features for classifying audio in the CueVideo system", Proc. 7th ACM Conf. on Multimedia, pp 393-400). Another related feature is the fraction of the signal blocks that lie below a threshold level (Saunders, J. (1996), "Real-time discrimination of broadcast speech/music", Proc. ICASSP 1996, Atlanta, Ga., pp 993-996; Liu, Z., Huang, J., Wang, Y., and Chen, T. (1997), "Audio feature extraction and analysis for scene classification", Proc. IEEE 1st Multimedia Workshop; Scheirer, E., and Slaney, M. (1997), "Construction and evaluation of a robust multifeature speech/music discriminator", Proc. ICASSP 1997, Munich, pp 1331-1334; Aarts, R. M., and Dekkers, R. T. (1999), "A real-time speech-music discriminator", J. Audio Eng. Soc., Vol. 47, pp 720-725; Tzanetakis, G., and Cook, P. (2000), "Sound analysis using MPEG compressed audio", Proc. ICASSP 2000, Istanbul, Vol. II, pp 761-764; Lu, L., Jiang, H., and Zhang, H. (2001), "A robust audio classification and segmentation method", Proc. 9th ACM Int. Conf. on Multimedia, Ottawa, pp 203-211; Zhang, T., and Kuo, C.-C. (2001), "Audio content analysis for online audiovisual data segmentation and classification", IEEE Trans. Speech and Audio Proc., Vol. 9, pp 441-457; Rizvi, S. J., Chen, L., and Özsu, T. (2002), "MADClassifier: Content-based continuous classification of mixed audio data", Tech. Report CS-2002-34, School of Comp. Sci., U. Waterloo, Ontario, Canada).

The shape of the spectrum is described by the mel cepstral coefficients (Carey, M. J., Parris, E. S., and Lloyd-Thomas, H. (1999), "A comparison of features for speech, music discrimination", Proc. ICASSP 1999, Phoenix, Ariz., paper 1432; Chou, W., and Gu, L. (2001), "Robust singing detection in speech/music discriminator design", Proc. ICASSP 2001, Salt Lake City, Utah, paper Speech-P9.4; Peltonen, V., Tuomi, J., Klapuri, A., Huopaniemi, J., and Sorsa, T. (2002), "Computational auditory scene recognition", Proc. ICASSP 2002, Orlando, Fla., Vol. II, pp 1941-1944). The cepstrum is the inverse Fourier transform of the logarithm of the power spectrum. The first coefficient gives the average of the log power spectrum, the second coefficient gives an indication of the slope of the log power spectrum, and the third coefficient indicates the degree to which the log power spectrum is concentrated towards the centre of the spectrum. The mel cepstrum is the cepstrum computed on an auditory frequency scale. The frequency-warped analysis inherently produces an auditory frequency scale, so the mel cepstrum naturally results from computing the cepstral analysis using the warped FFT power spectrum. The fluctuations of the short-time power spectrum from group to group are given by the delta cepstral coefficients (Carey, M. J., Parris, E. S., and Lloyd-Thomas, H. (1999), "A comparison of features for speech, music discrimination", Proc. ICASSP 1999, Phoenix, Ariz., paper 1432; Chou, W., and Gu, L. (2001), "Robust singing detection in speech/music discriminator design", Proc. ICASSP 2001, Salt Lake City, Utah, paper Speech-P9.4; Takeuchi, S., Yamashita, M., Uchida, T., and Sugiyama, M. (2001), "Optimization of voice/music detection in sound data", Proc. CRAC, Sep. 2, 2001, Aalborg, Denmark; Nordqvist, P., and Leijon, A. (2004), "An efficient robust sound classification algorithm for hearing aids", J. Acoust. Soc. Am., Vol. 115, pp 3033-3041). The delta cepstral coefficients are computed as the first difference of the mel cepstral coefficients.

Another indication of the shape of the power spectrum is the power spectrum centroid (Kates, J. M. (1995), "Classification of background noises for hearing-aid applications", J. Acoust. Soc. Am., Vol. 97, pp 461-470; Liu, Z., Huang, J., Wang, Y., and Chen, T. (1997), "Audio feature extraction and analysis for scene classification", Proc. IEEE 1st Multimedia Workshop; Scheirer, E., and Slaney, M. (1997), "Construction and evaluation of a robust multifeature speech/music discriminator", Proc. ICASSP 1997, Munich, pp 1331-1334; Tzanetakis, G., and Cook, P. (2000), "Sound analysis using MPEG compressed audio", Proc. ICASSP 2000, Istanbul, Vol. II, pp 761-764; Allegro, S., Büchler, M., and Launer, S. (2001), "Automatic sound classification inspired by auditory scene analysis", Proc. CRAC, Sep. 2, 2001, Aalborg, Denmark; Peltonen, V., Tuomi, J., Klapuri, A., Huopaniemi, J., and Sorsa, T. (2002), "Computational auditory scene recognition", Proc. ICASSP 2002, Orlando, Fla., Vol. II, pp 1941-1944). The centroid is the first moment of the power spectrum, and indicates where the power is concentrated in frequency. Changes in the shape of the power spectrum give rise to fluctuations of the centroid. These fluctuations are indicated by the standard deviation of the centroid (Tzanetakis, G., and Cook, P. (2000), "Sound analysis using MPEG compressed audio", Proc. ICASSP 2000, Istanbul, Vol. II, pp 761-764) and the first difference of the centroid (Allegro, S., Büchler, M., and Launer, S. (2001), "Automatic sound classification inspired by auditory scene analysis", Proc. CRAC, Sep. 2, 2001, Aalborg, Denmark).

The zero crossing rate (ZCR) tends to reflect the frequency of the strongest component in the spectrum. The ZCR will also be higher for noise than for a low-frequency tone such as the first formant in speech (Saunders, J. (1996), "Real-time discrimination of broadcast speech/music", Proc. ICASSP 1996, Atlanta, Ga., pp 993-996; Scheirer, E., and Slaney, M. (1997), "Construction and evaluation of a robust multifeature speech/music discriminator", Proc. ICASSP 1997, Munich, pp 1331-1334; Carey, M. J., Parris, E. S., and Lloyd-Thomas, H. (1999), "A comparison of features for speech, music discrimination", Proc. ICASSP 1999, Phoenix, Ariz., paper 1432; Srinivasan, S., Petkovic, D., and Ponceleon, D. (1999), "Towards robust features for classifying audio in the CueVideo system", Proc. 7th ACM Conf. on Multimedia, pp 393-400; El-Maleh, K., Klein, M., Petrucci, G., and Kabal, P. (2000), "Speech/music discrimination for multimedia applications", Proc. ICASSP 2000, Istanbul, Vol. IV, pp 2445-2448; Zhang, T., and Kuo, C.-C. (2001), "Audio content analysis for online audiovisual data segmentation and classification", IEEE Trans. Speech and Audio Proc., Vol. 9, pp 441-457; Peltonen, V., Tuomi, J., Klapuri, A., Huopaniemi, J., and Sorsa, T. (2002), "Computational auditory scene recognition", Proc. ICASSP 2002, Orlando, Fla., Vol. II, pp 1941-1944). Changes in the spectrum and shifts from tonal sounds to noise will cause changes in the ZCR, and these fluctuations are reflected in the standard deviation of the ZCR (Saunders, J. (1996), "Real-time discrimination of broadcast speech/music", Proc. ICASSP 1996, Atlanta, Ga., pp 993-996; Srinivasan, S., Petkovic, D., and Ponceleon, D. (1999), "Towards robust features for classifying audio in the CueVideo system", Proc. 7th ACM Conf. on Multimedia, pp 393-400; Lu, L., Jiang, H., and Zhang, H. (2001), "A robust audio classification and segmentation method", Proc. 9th ACM Int. Conf. on Multimedia, Ottawa, pp. 203-211). Because most of the power of a speech signal is concentrated in the first formant, a new feature, the ZCR of the signal first difference, was introduced to track the tonal characteristics of the high-frequency part of the signal.

Another potentially useful cue is the whether the spectrum is flat or has a peak. Spectral flatness (Allamanche, E., Herre, J., Hellmuth, O., Fröba, B., Kastner, T., and Cremer, M. (2001), "Content-based identification of audio material using MPEG-7 low level description", In *Proceedings of the Second Annual International Symposium on Music Information Retrieval*, Ed. by J. S. Downie and D. Bainbridge, Ismir, 2001, pp 197-204), the spectral crest factor (Allemanche et al., 2001, reported above; Rizvi, S. J., Chen, L., and Özsu, T. (2002), "MADClassifier: Content-based continuous classification of mixed audio data", Tech. Report CS-2002-34, School of Comp. Sci., U. Waterloo, Ontario, Canada), and tonality indicators (Allegro, S., Büchler, M., and Launer, S. (2001), "Automatic sound classification inspired by auditory scene analysis", Proc. CRAC, Sep. 2, 2001, Aalborg, Denmark) are all attempts to characterize the overall spectral shape as being flat or peaked. The spectral-shape indicator used in this study is the power spectral entropy, which will be high for a flat spectrum and low for a spectrum having one or more dominant peaks.

An additional class of features proposed for separating speech from music is based on detecting the rhythmic pulse present in many music selections (Scheirer, E., and Slaney, M. (1997), "Construction and evaluation of a robust multi-feature speech/music discriminator", Proc. ICASSP 1997, Munich, pp 1331-1334; Lu, L., Jiang, H., and Zhang, H. (2001), "A robust audio classification and segmentation method", Proc. $9^{th}$ ACM Int. Conf. on Multimedia, Ottawa, pp 203-211; Takeuchi, S., Yamashita, M., Uchida, T., and Sugiyama, M. (2001), "Optimization of voice/music detection in sound data", Proc. CRAC, Sep. 2, 2001, Aalborg, Denmark). If a rhythmic pulse is present, it is assumed that there will be periodic peaks in the signal envelope, which will cause a stable peak in the normalized autocorrelation function of the envelope. The location of the peak is given by the broadband envelope correlation lag, and the amplitude of the peak is given by the broadband envelope correlation peak. The rhythmic pulse should be present at all frequencies, so a multi-band procedure was also implemented in which the power spectrum was divided into four frequency regions (340-700, 900-1360, 1640-2360, and 2840-4240 Hz for the warping all-pass filter parameter a=0.5). The envelope autocorrelation function is computed separately in each frequency region, the normalized autocorrelation functions summed across the four bands, and the location and amplitude of the peak then found for the summed functions.

The 21 conventional features plus the log-level histograms were computed for three classes of signals: speech, classical music, and noise. There were 13 speech files from ten native speakers of Swedish (six male and four female), with the files ranging in duration from 12 to 40 sec. There were nine files for music, each 15 sec in duration, taken from commercially recorded classical music albums. The noise data consisted of four types of files. There were three segments of multi-talker babble ranging in duration from 111 to 227 sec, fourteen files of traffic noise recorded from a sidewalk and ranging in duration from 3 to 45 sec, two files recorded inside a moving automobile, and six miscellaneous noise files comprising keyboard typing, crumpling up a wad of paper, water running from a faucet, a passing train, a hairdryer, and factory noises.

Composite sound files were created by combining speech, music, and noise segments. First one of the speech files was chosen at random and one of the music files was also chosen at random. The type of noise was chosen by making a random selection of one of four types (babble, traffic, moving car, and miscellaneous), and then a file from the selected type was chosen at random. Entry points to the three selected files were then chosen at random, and each of the three sequences was normalized to have unit variance. For the target vector consisting of one signal class alone, one of the three classes was chosen at random and given a gain of 1, and the gains for the other two classes were set to 0. For the target vector consisting of a combination of two signal classes, one class was chosen at random and given a gain of 1. A second class chosen from the remaining two classes and given a random gain between 0 and −30 dB, and the gain for the remaining class was set to 0. The two non-zero gains were then normalized to give unit variance for the summed signal. The composite input signal was then computed as the weighted sum of the three classes using the corresponding gains.

The feature vectors were computed once every group of eight 24-sample blocks, which gives a sampling period of 12 ms (192 samples at the 16-kHz sampling rate). The processing to compute the signal features was initialized over the first 500 ms of data for each file. During this time the features were computed but not saved. The signal features were stored for use by the classification algorithms after the 500 ms initialization period. A total of 100 000 feature vectors (20 minutes of data) were extracted for training the neural network, with 250 vectors computed from each random combination of signal classes before a new combination was formed, the processing reinitialized, and 250 new feature vectors obtained. Thus features were computed for a total of 4000 different random combinations of the sound classes. A separate random selection of files was used to generate the test features.

To train the neural network, each vector of selected features was applied to the network inputs and the corresponding gains (separate classes or two-signal combination) applied to the outputs as the target vector. The order of the training feature and target vector pairs was randomized, and the neural network was trained on 100,000 vectors. A different randomized set of 100,000 vectors drawn from the sound files was then used to test the classifier. Both the neural network initialization and the order of the training inputs are governed by sequences of random numbers, so the neural network will produce slightly different results each time; the results were therefore calculated as the average over ten runs.

One important test of a sound classifier is the ability to accurately identify the signal class or the component of the signal combination having the largest gain. This task corresponds to the standard problem of determining the class when the signal is assumed a priori to represent one class alone. The standard problem consists of training the classifier using features for the signal taken from one class at a time, and then testing the network using data also corresponding to the signal taken from one class at a time. The results for the standard problem are shown in the first and fifth rows of Table 2 of FIG. 8 for the conventional features and the histogram systems, respectively. The neural network has an average accuracy of 95.4 percent using the conventional features, and an average accuracy of 99.3 percent using the log-level histogram inputs. For both types of input speech is classified most accurately, while the classifier using the conventional features has the greatest difficulty with music and the histogram system with noise.

Training the neural network using two-signal combinations and then testing using the separate classes produces the second and sixth rows of Table 2 of FIG. 8. The discrimination performance is reduced compared to both training and testing with separate classes because the test data does not correspond to the training data. The performance is still quite good, however, with an average of 91.9 percent correct for the conventional features and 97.7 percent correct for the log-level histogram inputs. Again the performance for speech is the best of the three classes, and noise identification is the poorest for both systems.

A more difficult test is identifying the dominant component of a two-signal combination. The test feature vectors for this task are all computed with signals from two classes present at the same time, so the test features reflect the signal combinations. When the neural network is trained on the separate classes but tested using the two-signal combinations, the performance degrades substantially. The average identification accuracy is reduced to 83.6 percent correct for the conventional features and 84.0 percent correct for the log-level histogram inputs. The classification accuracy has been reduced by about 15 percent compared to the standard procedure of training and testing using separate signal classes; this performance loss is indicative of what will happen when a system trained on ideal data is then put to work in the real world.

The identification performance for classifying the two-signal combinations for the log-level histogram inputs improves when the neural network is trained on the combinations instead of separate classes. The training data now match the test data. The average percent correct is 82.7 percent for the conventional features, which is only a small difference from the system using the conventional features that was trained on the separate classes and then used to classify the two-signal combinations. However, the system using the log-level histogram inputs improves to 88.3 percent correct, an improvement of 4.3 percent over being trained using the separate classes. The histogram performance thus reflects the difficulty of the combination classification task, but also shows that the classifier performance is improved when the system is trained for the test conditions and the classifier inputs also contain information about the signal combinations.

One remaining question is whether combining the log-level histograms with additional features would improve the classifier performance. The histograms contain information about the signal spectral distribution, but do not directly include any information about the signal periodicity. The neural network accuracy was therefore tested for the log-level histograms combined with features related to the zero-crossing rate (features 11-13 in Table 1 of FIG. 6) and rhythm (features 18-21 in Table 1 of FIG. 6). Twelve neurons were used in the hidden layer. The results in Table 2 of FIG. 8 show no improvement in performance when the temporal information is added to the log-level histograms.

The ideal classifier should be able to correctly identify both the weaker and the stronger components of a two-signal combination. The accuracy in identifying the weaker component is presented in Table 3 of FIG. 9. The neural network classifier is only about 50 percent accurate in identifying the weaker component for both the conventional features and the log-level histogram inputs. For the neural network using the conventional inputs, there is only a small difference in performance between being trained on separate classes and the two-signal combinations. However, for the log-level histogram system, there is an improvement of 7.7 percent when the training protocol matches the two-signal combination test conditions. The best accuracy is 54.1 percent correct, obtained for the histogram inputs trained using the two-signal combinations. The results for identifying the component not included in the two-signal combination is presented in Table 4 of FIG. 10, and these results are consistent with the performance in classifying the weaker of the two signal components present in the combination. Again, combining the histograms with the temporal information features gives no improvement in performance over using the log-level histograms alone.

These data again indicate that there is an advantage to training with the two-signal combinations when testing using combinations.

It is an important advantage that the histograms represent the spectra of the stronger and weaker signals in the combination in accordance with some embodiments. The log-level histograms are very effective features for classifying speech and environmental sounds. Further, the histogram computation is relatively efficient and the histograms are input directly to the classifier, thus avoiding the need to extract additional features with their associated computational load. The proposed log-level histogram approach is also more accurate than using the conventional features while requiring fewer non-linear elements in the hidden layer of the neural network.

In some embodiments, the histogram is normalized before input to the environment classifier. The histogram is normalized by the long-term average spectrum of the signal. For example, in one embodiment, the histogram values are divided by the average power in each frequency band. One procedure for computing the normalized histograms is presented in Appendix C.

Normalization of the histogram provides an input to the environment classifier that is independent of the microphone response but which will still include the differences in amplitude distributions for the different classes of signals.

For example, the log-level histogram will change with changes in the microphone frequency response caused by switching from omni-directional to directional characteristic or caused by changes in the directional response in an adaptive microphone array. For a directional microphone, the microphone transfer function from a sound source to the hearing aid depends on the direction of arrival. In a system that allows the user to select the microphone directional response pattern, the transfer function will differ for omni-directional and directional modes. In a system offering adaptive directionality, the transfer function will be constantly changing as the system adapts to the ambient noise field. These changes in the microphone transfer functions may result in time-varying spectra for the same environmental sound signal depending on the microphone and/or microphone array characteristics.

The log-level histograms contain information on both the long-term average spectrum and the spectral distribution. In a system with a time-varying microphone response, however, the average spectrum will change over time but the distribution of the spectrum samples about the long-term average will not be affected.

The normalized histogram values are advantageously immune to the signal amplitude and microphone frequency response and thus, are independent of type of microphone and array in the hearing aid.

Examples of normalized histograms are shown in FIGS. 11-13 for the same signal segments that were used for the log-level histograms of FIGS. 1-3. FIG. 11 shows the normalized histogram for the segment of speech used for the histogram of FIG. 1. The histogram bin index runs from 1 to 14, with bin 9 corresponding to 0 dB (signal power equal to the long-term average), and the bin width is 3 dB. The speech histogram shows the wide level distributions that result from the syllabic amplitude fluctuations. FIG. 12 shows the normalized histogram for the segment of classical music used for the histogram of FIG. 2. Compared to the speech normalized histogram of FIG. 11, the normalized histogram for the music shows a much tighter distribution. FIG. 13 shows the normalized histogram for the segment of noise used for the histogram of FIG. 3. Compared to the speech normalized histogram of FIG. 4, the normalized histogram for the noise shows a much tighter distribution, but the normalized histogram for the noise is very similar to that of the music.

In some embodiments, input signal envelope modulation is further determined and used as an input to the environment classifier. The envelope modulation is extracted by computing the warped FFT for each signal block, averaging the magnitude spectrum over the group of eight blocks, and then passing the average magnitude in each frequency band through a bank of modulation detection filters. The details of one modulation detection procedure are presented in Appendix D. Given an input sampling rate of 16 kHz, a block size of 24 samples, and a group size of 8 blocks, the signal envelope was sub-sampled at a rate of 83.3 Hz. Three modulation filters were implemented: band-pass filters covering the modulation ranges of 2-6 Hz and 6-20 Hz, and a 20-Hz high-pass filter. This general approach is similar to the modulation filter banks used to model the amplitude modulation detection that takes place in the auditory cortex (Dau, T., Kollmeier, B., and Kohlrausch, A. (1997), "Modeling auditory processing of amplitude modulation. I. Detection and masking with narrow-band carriers", J. Acoust. Soc. Am., Vol. 102, pp 2892-2905.; Derleth, R. P., Dau, T., and Kollmeier, B. (2001), "Modeling temporal and compressive properties of the normal and impaired auditory system", Hearing Res., Vol. 159, pp 132-149), and which can also serve as a basis for signal intelligibility and quality metrics (Holube, I., and Kollmeier, B. (1996), "Speech intelligibility predictions in hearing-impaired listeners based on a psychoacoustically motivated perception model", J. Acoust. Soc. Am., Vol. 100, pp 1703-1716; Hüber (2003), "Objective assessment of audio quality using an auditory processing model", PhD thesis, U. Oldenburg). The modulation frequency range of 2-20 Hz is important for speech (Houtgast, T., and Steeneken, H. J. M. (1973). "The modulation transfer function in room acoustics as a predictor of speech intelligibility," Acoustica 28, 66-73; Plomp, (1986). "A signal-to-noise ratio model for the speech-reception threshold of the hearing impaired," J. Speech Hear. Res. 29, 149-154), and envelope modulations in the range above 20 Hz give rise to the auditory percept of roughness (Zwicker, E., and Fastl, H. (1999), *Psychoacoustics: Facts and Models* ($2^{nd}$ *Ed.*), New York: Springer).

The output of each envelope modulation detection filter may then be divided by the overall envelope amplitude in the frequency band to give the normalized modulation in each of the three modulation frequency regions. The normalized modulation detection thus reflects the relative amplitude of the envelope fluctuations in each frequency band, and does not depend on the overall signal intensity or long-term spectrum. The modulation detection gives three filter outputs in each of the 17 warped FFT frequency bands. The amount of information may be reduced, as for the histograms, by taking the outputs in only the even-numbered frequency bands (numbering the FFT bins from 1 through 17). This gives a modulation feature vector having 8 frequency bands×3 filters per band=24 values.

Examples of the normalized envelope modulation detection are presented in FIGS. 14-16 for the same signal segments that were used for the log-level histograms of FIGS. 1-3. FIG. 14 shows the modulation detection for the segment of speech used for the histogram of FIG. 1. Low refers to envelope modulation in the 2-6 Hz range, mid to the 6-20 Hz range, and high to above 20 Hz. The speech is characterized by large amounts of modulation in the low and mid ranges covering 2-20 Hz, as expected, and there is also a large amount of modulation in the high range. FIG. 15 shows the envelope modulation detection for the same music segment as used for FIG. 2. The music shows moderate amounts of envelope modulation in all three ranges, and the amount of modulation is substantially less than for the speech. FIG. 16 shows the envelope modulation detection for the same noise segment as used for FIG. 3. The noise has the lowest amount of envelope modulation of the signals considered for all three modulation frequency regions. The different amounts of envelope modulation for the three signals show that modulation detection may provide a useful set of features for signal classification.

The normalized envelope modulation values are advantageously immune to the signal amplitude and microphone frequency response and thus, are independent of type of microphone and array in the hearing aid.

Combining the normalized histogram with the normalized envelope modulation detection improves classifier accuracy as shown below. This combination of features may be attractive in producing a universal classifier that can operate in any hearing aid no matter what microphone or array algorithm is implemented in the device.

The normalized histogram will reduce the classifier sensitivity to changes in the microphone frequency response, but the level normalization may also reduce the amount of information related to some signal classes. The histogram contains information on the amplitude distribution and range of the signal level fluctuations, but it does not contain information on the fluctuation rates. Additional information on the signal envelope fluctuation rates from the envelope modulation detection therefore compliments the histograms and improves classifier accuracy, especially when using the normalized histograms.

The log-level histograms, normalized histograms, and envelope modulation features were computed for three classes of signals: speech, classical music, and noise. The stimulation files described above in relation to the log level histogram embodiment and the neural network shown in FIG. 7 are also used here.

The classifier results are presented in Tables 1-3. The system accuracy in identifying the stronger signal in the two-signal mixture is shown in Table 1 of FIG. 6. The log-level histograms give the highest accuracy, with an average of 88.3 percent correct, and the classifier accuracy is nearly the same for speech, music, and noise. The normalized histogram shows a substantial reduction in classifier accuracy compared to that for the original log-level histogram, with the average classifier accuracy reduced to 76.7 percent correct. The accuracy in identifying speech shows a small reduction of 4.2 percent, while the accuracy for music shows a reduction of 21.9 percent and the accuracy for noise shows a reduction of 8.7 percent.

The set of 24 envelope modulation features show an average classifier accuracy of 79.8 percent, which is similar to that of the normalized histogram. The accuracy in identifying speech is 2 percent worse than for the normalized histogram and 6.6 percent worse than for the log-level histogram. The envelope modulation accuracy for music is 11.3 percent better than for the normalized histogram, and the accuracy in identifying noise is the same. Thus the amount of information provided by the envelope modulation appears to be comparable overall to that provided by the normalized histogram, but substantially lower than that provided by the log-level histogram.

Combining the envelope modulation with the normalized histogram shows an improvement in the classifier accuracy as compared to the classifier based on the normalized histogram alone. The average accuracy for the combined system is 3.9 percent better than for the normalized histogram alone. The accuracy in identifying speech improved by 6.3 percent, and the 86.9 percent accuracy is comparable to the accuracy of 86.8 percent found for the system using the log-level histogram. The combined envelope modulation and normalized histogram shows no improvement in classifying music over the normalized histogram alone, and shows an improvement of 5.5 percent in classifying noise.

Similar performance patterns are indicated in Table 2 of FIG. 8 for identifying the weaker signal in the two-signal mixture and in Table 3 of FIG. 9 for identifying the signal left out of the mixture.

The combination of normalized histogram with envelope modulation detection is immune to changes in the signal level or long-term spectrum. Such a system could also offer advantages as a universal sound classification algorithm that could be used in all hearing aids no matter what type of microphone or microphone array processing was implemented.

APPENDIX A

Conventional Signal Features

A total of 21 features are extracted from the incoming signal. The features are listed in the numerical order of Table 1 of FIG. 6 and described in this appendix. The quiet threshold used for the vector quantization is also described. The signal sampling rate is 16 kHz. The warped signal processing uses a block size of 24 samples, which gives a block sampling rate of 667 Hz. For all of the features, the block outputs are combined into groups of 8 blocks, which results in a feature sampling period of 12 ms and a corresponding sampling rate of 83 Hz.

Feature 1. Mean-Squared Signal Power

The input signal sequence is x(n). Define N as the number of samples in a block (N=24) and L as the number of blocks in a group (L=8). The mean-squared signal power for group m is the average of the square of the input signal summed across all of the blocks that make up the group:

$$p(m) = \frac{1}{NL}\sum_{j=0}^{NL-1} x^2(n-j) \tag{A.1}$$

Feature 2. Standard Deviation of the Signal Envelope

The signal envelope is the square root of the mean-squared signal power and is given by $$s(m)=[p(m)]^{1/2} \tag{A.2}$$

Estimate the long-term signal power and the long-term signal envelope using a one-pole low-pass filter having a time constant of 200 ms, giving $$\hat{p}(m)=\alpha\hat{p}(m-1)+(1-\alpha)p(m)$$

$$\hat{s}(m)=\alpha\hat{s}(m-1)+(1-\alpha)s(m) \tag{A.3}$$

The standard deviation of the signal envelope is then given by $$\sigma(m)=[\hat{p}(m)-\hat{s}^2(m)]^{1/2} \tag{A.4}$$

Features 3-6. Mel Cepstrum Coefficients 1 Through 4

The power spectrum of the signal is computed from the output of the warped FFT. Let X(k,l) be the warped FFT output for bin k, 1≤k≤K, and block I. The signal power for group m is then given by the sum over the blocks in the group:

$$P(k, m) = \frac{1}{L}\sum_{l=0}^{L-1} |X(k, l)|^2 \tag{A.5}$$

The warped spectrum is uniformly spaced on an auditory frequency scale. The mel cepstrum is the cepstrum computed on an auditory frequency scale, so computing the cepstrum using the warped FFT outputs automatically produces the mel cepstrum. The mel cepstrum coefficients are low-pass filtered using a one-pole low-pass filter having a time constant of 200 ms. The $j^{th}$ mel cepstrum coefficient for group m is thus given by $$cep_j(m) = \alpha cep_j(m-1) + (1-\alpha)\sum_{k=0}^{K-1} \log[P(k, m)]c_j(k) \tag{A.6}$$

where $c_j(k)$ is the $j^{th}$ weighting function, 1≤j≤4, given by $$c_j(k)=\cos[(j-1)k\pi/(K-1)] \tag{A.7}$$

Features 7-10. Delta Cepstrum Coefficients 1 Through 4

The delta cepstrum coefficients are the first differences of the mel cepstrum coefficients computed using Eq (A.6). The delta cepstrum coefficients are thus given by $$\Delta cep_j(m)=cep_j(m)-cep_j(m-1). \tag{A.8}$$

Features 11-13. Zero-Crossing Rate (ZCR), ZCR of Signal First Difference, and Standard Deviation of the ZCR.

The zero-crossing rate (ZCR) for the $m^{th}$ group of blocks is defined as $$ZCR(m) = \sum_{n=0}^{NL-1} |\text{sign}[x(n)] - \text{sign}[x(n-1)]|. \tag{A.9}$$

where NL is the total number of samples in the group. The ZCR is low-pass filtered using a one-pole filter having a time constant of 200 ms, giving the feature $$z(m)=\alpha z(m-1)+(1-\alpha)\text{ZCR}(m) \tag{A.10}$$

The ZCR of the first difference is computed using Eqs. (A.9) and (A.10), but with the first difference of the signal y(n)=x(n)−x(n−1) replacing the signal x(n).

The standard deviation of the ZCR is computed using the same procedure as is used for the signal envelope. The average of the square of the ZCR is given by $$v(m)=\alpha v(m-1)+(1-\alpha)\text{ZCR}^2(m) \tag{A.11}$$

The standard deviation of the ZCR is then estimated using $$\zeta(m)=[v(m)-z^2(m)]^{1/2} \tag{A.12}$$

Features 14-16. Power Spectrum Centroid, Delta Centroid, and Standard Deviation of the Centroid The power spectrum centroid is the first moment of the power spectrum. It is given by $$\text{centroid}(m) = \sum_{k=0}^{K-1} kP(k, m) \Big/ \sum_{k=0}^{K-1} P(k, m) \tag{A.13}$$

The centroid feature is the low-pass filtered centroid, using a one-pole low-pass filter having a time constant of 200 ms, given by $$f(m)=\alpha f(m-1)+(1-\alpha)\text{centroid}(m) \tag{A.14}$$

The delta centroid feature is then given by the first difference of the centroid:

$$\Delta f(m)=f(m)-f(m-1) \tag{A.15}$$

The standard deviation of the centroid uses the average of the square of the centroid, given by $$u(m)=\alpha u(m-1)+(1-\alpha)\text{centroid}^2(m) \tag{A.16}$$

with the standard deviation then given by $$v(m)=[u(m)-f^2(m)]^{1/2} \tag{A.17}$$

Feature 17. Power Spectrum Entropy

The power spectrum entropy is an indication of the smoothness of the spectrum. First compute the fraction of the total power in each warped FFT bin:

$$\rho(k, m) = P(k, m) \Big/ \sum_{k=0}^{K-1} P(k, m) \tag{A.18}$$

The entropy in bits for the group of blocks is then computed and low-pass filtered (200-ms time constant) to give the signal feature:

$$e(m) = \alpha e(m-1) + (1-\alpha)\sum_{k=0}^{K-1} \rho(k, m)\log_2[\rho(k, m)] \tag{A.19}$$

Features 18-19. Broadband Envelope Correlation Lag and Peak Level

The broadband signal envelope uses the middle of the spectrum, and is computed as $$b(m) = \sum_{k=2}^{13} [P(k, m)]^{1/2} \tag{A.20}$$

where the warped FFT has 17 bins, numbered from 0 through 16, covering the frequencies from 0 through π. The signal envelope is low-pass filtered using a time constant of 500 ms to estimate the signal mean:

$$\mu(m)=\beta\mu(m-1)+(1-\beta)b(m) \tag{A.21}$$

The signal envelope is then converted to a zero-mean signal:

$$a(m)=b(m)-\mu(m). \tag{A.22}$$

The zero-mean signal is center clipped:

$$\hat{a}(m) = \begin{cases} a(m), & |a(m)| \geq 0.25\,\mu(m) \\ 0, & |a(m)| < 0.25\,\mu(m) \end{cases} \tag{A.23}$$

The envelope autocorrelation is then computed over the desired number of lags (each lag represents one group of blocks, or 12 ms) and low-pass filtered using a time constant of 1.5 sec:

$$R(j,m)=\gamma R(j,m-1)+(1-\gamma)\hat{a}(m)\hat{a}(m-j) \tag{A.24}$$

where j is the lag.

The envelope autocorrelation function is then normalized to have a maximum value of 1 by forming $$r(j,m)=R(j,m)/R(0,m) \tag{A.25}$$

The maximum of the normalized autocorrelation is then found over the range of 8 to 48 lags (96 to 576 ms). The location of the maximum in lags is the broadband lag feature, and the amplitude of the maximum is the broadband peak level feature.

Features 20-21. Four-Band Envelope Correlation Lag and Peak Level

The four-band envelope correlation divides the power spectrum into four non-overlapping frequency regions. The signal envelope in each region is given by $$\begin{aligned} b_1(m) &= \sum_{k=2}^{4} [P(k, m)]^{1/2} \\ b_2(m) &= \sum_{k=5}^{7} [P(k, m)]^{1/2} \\ b_3(m) &= \sum_{k=8}^{10} [P(k, m)]^{1/2} \\ b_4(m) &= \sum_{k=11}^{13} [P(k, m)]^{1/2} \end{aligned} \tag{A.26}$$

The normalized autocorrelation function is computed for each band using the procedure given by Eqs. (A.21) through (A.25). The normalized autocorrelation functions are then averaged to produce the four-band autocorrelation function:

$$\hat{r}(j, m) = \frac{1}{4}[r_1(j, m) + r_2(j, m) + r_3(j, m) + r_4(j, m)] \tag{A.27}$$

The maximum of the four-band autocorrelation is then found over the range of 8 to 48 lags. The location of the maximum in lags is the four-band lag feature, and the amplitude of the maximum is the four-band peak level feature.

APPENDIX B

Log-Level Histogram

The dB level histogram for group m is given by $h_m(j,k)$, where j is the histogram dB level bin index and k is the frequency band index. The histogram bin width is 3 dB, with $1 \leq j \leq 14$. Bin 14 corresponds to 0 dB. The first step in updating the histogram is to decay the contents of the entire histogram:

$$\hat{h}_{m+1}(j,k)=\beta h_m(j,k), \forall j,k \tag{B.1}$$

where β corresponds to a low-pass filter time constant of 500 ms.

The signal power in each band is given by $$P(k, m) = \frac{1}{L}\sum_{l=0}^{L-1} |X(k, l)|^2, \tag{B.2}$$

where X(k,l) is the output of the warped FFT for frequency bin k and block I. The relative power in each frequency band is then given by $$\rho(k, m) = P(k, m) \Big/ \sum_{k=0}^{K-1} P(k, m). \tag{B.3}$$

The relative power in each frequency band is given by $\rho(k,m+1)$ from Eq (A.18). The relative power in each frequency band is converted to a dB level bin index:

$$i(k,m+1)=1+\{40+10\log_{10}[\rho(k,m+1)]\}/3 \tag{B.4}$$

which is then rounded to the nearest integer and limited to a value between 1 and 14. The histogram dB level bin corresponding to the index in each frequency band is then incremented:

$$h_{m+1}[i(k,m+1),k]=\hat{h}_{m+1}[i(k,m+1),k]+(1-\beta) \tag{B.5}$$

In steady state, the contents of the histogram bins in each frequency band sum to 1.

APPENDIX C

Normalized Histogram

To compute the normalized log-level histogram, the spectrum in each frequency band is divided by the average level in the band, and the histogram computed for the deviation from the average level. The dB level histogram for group m is given by $g_m(j,k)$, where j is the histogram dB level bin index and k is the frequency band index. The histogram bin width is 3 dB, with $1 \le j \le 14$. The first step in updating the histogram is to decay the contents of the entire histogram:

$$\hat{g}_m(j,k)=\beta g_{m-1}(j,k), \forall j,k \tag{C.1}$$

where $\beta$ corresponds to a low-pass filter time constant of 500 msec.

The average power in each frequency band is given by $$Q(m,k)=\alpha Q(m-1,k)+(1-\alpha)P(m,k) \tag{C.2}$$

where $\alpha$ corresponds to a time constant of 200 msec. The normalized power is then given by $$\hat{P}(m, k) = \frac{P(m, k)}{Q(m, k)}. \tag{C.3}$$

The normalized power in each frequency band is converted to a dB level bin index $$j(k,m)=1+\{25+10\log_{10}[\hat{P}(k,m)]\}/3, \tag{C.4}$$

which is then rounded to the nearest integer and limited to a value between 1 and 14. The histogram dB level bin corresponding to the index in each frequency band is then incremented:

$$g_m[j(k,m),k]=\hat{g}_m[j(k,m),k]+(1-\beta). \tag{C.5}$$

In steady state, the contents of the histogram bins in each frequency band sum to 1.

APPENDIX D

Envelope Modulation Detection

The envelope modulation detection starts with the power in each group of blocks P(k,m). Sampling parameters were a sampling rate of 16 kHz for the incoming signal, a block size of 24 samples, and a group size of 8 blocks; the power in each group was therefore sub-sampled at 83.3 Hz. The envelope in each band was then averaged using a low-pass filter to give $$U(k,m)=\alpha U(k,m-1)+(1-\alpha)[P(m,k)]^{1/2} \tag{D.1}$$

where $\alpha$ corresponds to a time constant of 200 msec.

The envelope samples U(k,m) in each band were filtered through two band-pass filters covering 2-6 Hz and 6-10 Hz and a high-pass filter at 20 Hz. The filters were all IIR 3-pole Butterworth designs implemented using the bilinear transform. Let the output of the 2-6 Hz band-pass filter be $E_1(k,m)$, the output of the 6-10 Hz band-pass filter be $E_2(k,m)$, and the output of the high-pass filter be $E_3(k,m)$. The output of each filter was then full-wave rectified and low-pass filtered to give the average envelope modulation power in each of the three modulation detection regions:

$$\hat{E}_j(k,m)=\alpha\hat{E}_j(k,m-1)+(1-\alpha)|E_j(k,m)| \tag{D.2}$$

where $\alpha$ corresponds to a time constant of 200 msec.

The average modulation in each modulation frequency region for each frequency band is then normalized by the total envelope in the frequency band:

$$A_j(k, m) = \frac{\hat{E}_j(k, m)}{U(k, m)} \tag{D.3}$$

The invention claimed is:

1. A hearing aid comprising:

a microphone and an A/D converter for provision of a digital input signal in response to a sound signal received at the microphone in a sound environment;

a processor that is configured to process the digital input signal in accordance with a signal processing algorithm to generate a processed output signal;

a D/A converter and an output transducer for conversion of the processed output signal to an acoustic output signal; and a sound environment detector for determination of the sound environment based at least in part on the digital input signal, and for providing an output for selection of the signal processing algorithm, the sound environment detector including a feature extractor for determination of histogram values of the digital input signal in a plurality of frequency bands, and an environment classifier configured for receiving the histogram values as input, and classifying the sound environment by selecting one of a plurality of environmental classes based at least in part on the histogram values from at least two of the plurality of frequency bands;

wherein the environment classifier is configured for classifying background noise in the sound environment using at least some of the histogram values.

2. The hearing aid according to claim 1, wherein the feature extractor is configured to determine histograms in a plurality of frequency warped frequency bands.

3. The hearing aid according to claim 1, wherein the feature extractor is configured to determine histograms of the digital input signal.

4. The hearing aid according to claim 1, wherein the feature extractor is configured to determine histograms of a logarithmic digital input signal.

5. The hearing aid according to claim 1, wherein the environment classifier is configured to receive information derived from the histogram values as input.

6. The hearing aid according to claim 1, wherein the environment classifier is configured to receive normalized histogram values as input.

7. The hearing aid according to claim 1, wherein the histogram values represent a time during which signal levels reside within a corresponding signal level range.

8. The hearing aid according to claim 7, wherein the environment classifier is configured to be trained with a combination of signals from different signal classes.

9. The hearing aid according to claim 1, wherein the environment classifier comprises at least one element selected from the group consisting of a neural network, a hidden Markov Model, a Bayesian classifier, a nearest neighbour classifier, a support vector machine, and a relevance vector machine.

10. The hearing aid according to claim 1, wherein the environment classifier is configured to classify the sound environment based at least in part on the histogram values as a function of frequency.

11. The hearing aid according to claim 1, wherein the at least two of the plurality of frequency bands are selected frequency bands.

12. The hearing aid according to claim 1, wherein the environment classifier is configured to classify the sound environment based at least in part on the histogram values in combination with at least one other signal parameter.

13. The hearing aid according to claim 12, wherein the at least one other signal parameter is selected from the group consisting of a zero-crossing rate, a delta zero crossing rate, a higher moment of zero crossing rate, a mel cepstrum coefficient, a delta cepstrum coefficient, a harmonics content, a flatness, a crest factor, a tonality, a spectral envelope, a block energy, an on-offset time, a silence ratio, an amplitude histogram, an autocorrelation, a pitch, a delta pitch, and a variance.

14. The hearing aid according to claim 1, wherein the feature extractor is further configured to envelope modulation detection and to input envelope modulation features to the environment classifier.

15. The hearing aid according to claim 1, wherein the histogram values from the at least two of the plurality of frequency bands comprise at least four histogram bin values.

16. The hearing aid according to claim 1, wherein the environment classifier is configured for determining a strongest part of the sound signal.

17. The hearing aid according to claim 1, wherein the environment classifier is configured for determining a part of the sound signal that is weaker than a strongest part of the sound signal.

18. The hearing aid according to claim 1, wherein the environment classifier is configured to classify the sound environment based at least in part on at least one parameter derived from the histogram values.

19. The hearing aid according to claim 18, wherein the at least one parameter is selected from the group consisting of a median, a mean, and a standard deviation of the histogram values.

20. The hearing aid according to claim 1, wherein the environment classifier is also configured for classifying desired sound for hearing by a user of the hearing aid.

21. The hearing aid according to claim 20, wherein the environment classifier is also configured to determine a proportion of each of the classified background noise and the classified desired sound.

22. The hearing aid according to claim 1, wherein the background noise comprises speech, music, restaurant clatter, or traffic noise.

23. The hearing aid according to claim 1, wherein the sound signal comprises a first component representing desired sound for hearing by a user of the hearing aid, and a second component representing the background noise in the sound environment.

24. A hearing aid comprising a sound environment detector for determination of a sound environment, the sound environment detector comprising:

a feature extractor for determination of histogram values of a digital input signal in a plurality of frequency bands;

an environment classifier configured for receiving the histogram values as input, and classifying the sound environment by selecting one of a plurality of environmental classes based at least in part on the histogram values from at least two of the plurality of frequency bands; and a parameter map for the provision of an output for the selection of a signal processing algorithm for a processor;

wherein the environment classifier is configured for classifying background noise in the sound environment using at least some of the histogram values.

25. The hearing aid according to claim 1, wherein the sound environment detector further includes a parameter map for providing the output for selection of the signal processing algorithm.

26. The hearing aid according to claim 24, wherein the environment classifier is also configured for classifying desired sound for hearing by a user of the hearing aid.

27. The hearing aid according to claim 26, wherein the environment classifier is also configured to determine a proportion of each of the classified background noise and the classified desired sound.

28. The hearing aid according to claim 24, wherein the background noise comprises speech, music, restaurant clatter, or traffic noise.

29. The hearing aid according to claim 24, wherein the background noise is different from desired sound for hearing by a user of the hearing aid.

* * * * *